US010883312B2

(12) United States Patent
McMillan

(10) Patent No.: US 10,883,312 B2
(45) Date of Patent: Jan. 5, 2021

(54) PERCUSSION DEVICE

(71) Applicant: Jaron Lyell McMillan, Canterbury (NZ)

(72) Inventor: Jaron Lyell McMillan, Canterbury (NZ)

( * ) Notice: Subject to any disclaimer, the term of this patent is extended or adjusted under 35 U.S.C. 154(b) by 319 days.

(21) Appl. No.: 15/763,454

(22) PCT Filed: Sep. 29, 2016

(86) PCT No.: PCT/IB2016/055812
§ 371 (c)(1),
(2) Date: Mar. 27, 2018

(87) PCT Pub. No.: WO2017/056026
PCT Pub. Date: Apr. 6, 2017

(65) Prior Publication Data

US 2018/0274298 A1 Sep. 27, 2018

(30) Foreign Application Priority Data

Sep. 30, 2015 (NZ) ..... 712842

(51) Int. Cl.
*E21B 4/10* (2006.01)
*E21B 6/04* (2006.01)
(Continued)

(52) U.S. Cl.
CPC ..... *E21B 4/10* (2013.01); *E02D 7/02* (2013.01); *E02D 7/26* (2013.01); *E21B 6/04* (2013.01);
(Continued)

(58) Field of Classification Search
CPC . E21B 4/10; E21B 4/16; E21B 31/107; E21B 6/04; E21B 6/06; E21B 6/08; E21B 7/02; E02D 7/02; E02D 7/26
See application file for complete search history.

(56) References Cited

U.S. PATENT DOCUMENTS 1,358,303 A 11/1920 Farmer
1,415,958 A 5/1922 Smith
(Continued)

FOREIGN PATENT DOCUMENTS

FR 2364325 4/1978
GB 926108 5/1963
(Continued)

OTHER PUBLICATIONS

Kahraman et al., Dominant rock properties affecting the penetration rate of percussive drills, International Journal of Rock Mechanics & Mining Sciences 40 (2003) 711-723, published 2003.
(Continued)

*Primary Examiner* — Thomas M Wittenschlaeger
(74) *Attorney, Agent, or Firm* — Galbreath Law Offices, P.C.; John A. Galbreath

(57) ABSTRACT

A percussion device that includes: —an input side; —an output side; —at least one drive transmitter; —a drive transmitter pathway; —a percussion impactor; and —a percussion anvil; where: the drive transmitter pathway is a circumferential pathway around a longitudinal axis of the percussion device; —the drive transmitter pathway includes at least one tooth section including a lift section and a lead section; —the at least one tooth section is essentially one wavelength of a sawtooth wave; —the lift section is inclined away from a base of the drive transmitter pathway; —the lead section is a section of the tooth section which abruptly returns to the base of the drive transmitter pathway; —the input side is rotationally isolated from the percussion impactor; —the percussion anvil is attached to, or forms part of, the output side; —the percussion impactor includes an impact end and a force input end which are longitudinally opposite terminal ends of the percussion impactor; and —the impact end faces the percussion anvil; such that: when in
(Continued)

use, and the output section is free to rotate, the at least one drive transmitter and the drive transmitter pathway are configured to act co¬ operatively to transfer the rotational motion of the input side to the output side; and —when in use and limited or no rotation of the output side is possible, the at least one drive transmitter and the drive transmitter pathway are configured to act co-operatively to increase, maintain or decrease the distance between the percussion impactor and the percussion anvil; wherein the at least one drive transmitter and the drive transmitter pathway are configured to act co-operatively to accept rotational motion from the input side and transmit a percussive and/or rotational motion to the output side.

23 Claims, 14 Drawing Sheets

(51) Int. Cl.
*E21B 7/02* (2006.01)
*E21B 6/06* (2006.01)
*E02D 7/26* (2006.01)
*E02D 7/02* (2006.01)
*E21B 31/107* (2006.01)

(52) U.S. Cl.
CPC ..... *E21B 6/06* (2013.01); *E21B 7/02* (2013.01); *E21B 31/107* (2013.01)

(56) References Cited

U.S. PATENT DOCUMENTS 1,452,581 A 4/1923 Welch
1,566,733 A 12/1925 Carter
1,607,082 A * 11/1926 Howcott ..... E21B 4/10 175/106
1,653,093 A * 12/1927 Fleming ..... E21B 4/10 175/298
1,760,582 A 5/1930 Clark
1,845,074 A * 2/1932 Billstrom ..... E21B 4/10 175/298
1,901,513 A * 3/1933 Harris ..... A47J 36/04 175/298
2,047,125 A 7/1936 Gartin
2,054,255 A * 9/1936 Howard ..... E21B 4/10 175/298
2,120,240 A * 6/1938 Chappell ..... E21B 4/10 175/248
2,128,321 A 8/1938 Reilly
2,144,810 A * 1/1939 Raymond ..... E21B 31/107 175/303
2,146,454 A * 2/1939 Sutliff ..... E21B 4/10 175/298
2,168,541 A 8/1939 Slater
2,214,970 A * 9/1940 Mooney ..... E21B 4/06 175/242
2,220,195 A 11/1940 Amundsen
2,221,117 A 11/1940 Smith
2,228,482 A * 1/1941 Prebensen ..... E21B 4/10 175/298
2,495,364 A * 1/1950 Clapp ..... E21B 4/10 175/195
2,737,818 A 3/1956 Feucht
2,742,264 A * 4/1956 Suyder ..... E21B 4/10 175/298
2,742,265 A * 4/1956 Snyder ..... E21B 4/10 175/56
3,059,618 A 10/1962 Osgood
3,256,946 A * 6/1966 Jansen ..... B25D 11/102 173/97
3,268,014 A * 8/1966 Drew ..... B25D 11/102 173/97
3,396,807 A * 8/1968 Menton ..... E21B 4/10 175/293
3,713,481 A * 1/1973 Webb ..... E21B 4/10 166/55
3,837,414 A * 9/1974 Swindle ..... E21B 4/06 175/299
4,006,783 A 2/1977 Granholm
4,062,203 A * 12/1977 Leonard ..... B25B 23/141 464/38
4,082,151 A * 4/1978 Finney ..... B25D 11/102 173/203
4,366,868 A 1/1983 Salmi
4,384,622 A * 5/1983 Koziniak ..... B25C 1/001 173/117
4,408,670 A * 10/1983 Schoeffler ..... E21B 4/10 175/298
4,705,118 A * 11/1987 Ennis ..... E21B 21/12 175/65
4,846,288 A 7/1989 Hunt
4,867,250 A * 9/1989 Ono ..... B25B 21/02 173/93
5,435,402 A * 7/1995 Ziegenfuss ..... E21B 4/02 175/414
6,745,836 B2 * 6/2004 Taylor ..... E21B 4/006 166/178
6,942,046 B2 * 9/2005 Binon ..... E21B 6/06 175/305
7,063,149 B2 * 6/2006 Simpson ..... E21B 4/10 166/277
7,073,610 B2 * 7/2006 Susman ..... E21B 4/14 173/53
7,255,182 B1 * 8/2007 Ware ..... E21B 6/00 175/293
7,419,018 B2 * 9/2008 Hall ..... E21B 4/06 175/106
7,604,070 B2 10/2009 Kemppainen
9,488,010 B2 * 11/2016 von Gynz-Rekowski ..... E21B 4/10
10,000,970 B2 * 6/2018 Tulloch ..... E21B 4/003
10,280,700 B2 * 5/2019 Moyes ..... E21B 31/113
10,415,314 B2 * 9/2019 Kartha ..... E21B 6/02

FOREIGN PATENT DOCUMENTS

GB 2322675 9/1998
WO WO2002101192 12/2002

OTHER PUBLICATIONS

Doofor DF550L-EXT Hydraulic Rock Drill, URL Address: http://www.doofor.com/files/media/doofor-df5501-ext-brochure-2016.pdf, original publication date unknown, website accessed Sep. 2016.

* cited by examiner

PERCUSSION DEVICE

TECHNICAL FIELD

The present invention is a device that imparts a percussive force to a tool when that tool meets resistance to rotation, if the resistance continues this percussive force can be periodically applied. Specific applications include rock drills used to drill into the ground and small drills used to drill concrete and the like where variations in the material being drilled can slow or stall the drill; and pile drivers. In an alternative form the device incorporates a locking mechanism that forces the percussive device into a percussion only form.

BACKGROUND ART

When a drill is used to drill into rock it can meet material that can slow or stop that drill, to continue drilling the drill head can be backed off from the surface and whilst rotating the drill head pushed into contact in an attempt to clear the material to recommence the drilling operation. This takes time and does not always allow drilling to recommence, sometimes the drill needs to be withdrawn and a different drill head or drill used until the obstructive material is cleared or passed through. If the drill is rotating and it meets material that stops the drill's rotation quickly then damage to the drill head and/or drill string and/or drive unit may occur.

Conventional drilling is often used with non-impact, purely friction methods, this is, or can be, slow.

To overcome the requirement to withdraw the drill, or back the drill head off and back into contact, some drill strings incorporate a percussion unit to apply a periodic percussive force to the drill string or drill tip. These devices include percussion hammers driven by pneumatic or hydraulic systems these can be expensive to run, require an auxiliary source of energy to run the percussion, often via the drilling fluid medium. These devices often require compressed air which in some situations can be problematic. In addition many of these percussion devices operate continuously or at a fixed rate once engaged; this may not be optimum in many situations. Often the drill head on a percussion hammer drill string is held on by one or more split rings, if these rings break the drill head can be lost, or at least difficult to recover.

For some subsurface operations it would be useful to apply a percussive force with some rotational impulse, however percussion hammers cannot do this.

Any discussion of the prior art throughout the specification is not an admission that such prior art is widely known or forms part of the common general knowledge in the field.

It is an object of the present invention to provide a solution to ameliorate one or more of the problems outlined above, or at least provide a consumer with a useful choice.

DISCLOSURE OF INVENTION

The present invention provides a percussion device including an input side;

an output side;

a percussion impactor; and an outer casing; where either the percussion impactor or the outer casing includes a drive transmitter pathway; and either the outer casing or the percussion impactor includes at least one drive transmitter, such that if the percussion impactor includes the drive transmitter pathway the outer casing includes at least one drive transmitter and vice versa.

Preferably at least one of said at least one drive transmitter is configured to slide or roll along at least part of a length of said drive transmitter pathway.

Preferably, where the drive transmitter pathway is part of the percussion impactor, the percussion impactor includes an impact end and a force input end (FI end) where the impact end and the FI end are the opposite terminal ends of the percussion impactor, and the drive transmitter pathway includes at least one lift section and at least one lead section.

Preferably, where the drive transmitter pathway is part of the percussion impactor, as you move along any one lift section the distance between the FI end and the drive transmitter pathway increases, and as you move along any one lead section the distance between the FI end and the drive transmitter pathway suddenly decreases to a minimum, one lift section followed by one lead section forms a tooth section.

Alternatively, where the drive transmitter pathway is part of the percussion impactor, as you move along any one lift section the distance between the FI end and the drive transmitter pathway initially decreases forming a scalloped section at the start of the lift section, then the distance increases, and as you move along any one lead section the distance between the FI end and the drive transmitter pathway suddenly decreases to a minimum, one lift section followed by one lead section forms a tooth section.

In a preferred form, where the drive transmitter pathway is part of the percussion impactor, as you move along the lift section at a constant rate, the rate of change of the distance between the FI end and the drive transmitter pathway changes, creating a variable slope to the lift section.

Preferably there are at least two drive transmitters. In a highly preferred form there are an even number of drive transmitters. Preferably there are from 1 to 8 drive transmitters.

Preferably, where the drive transmitter pathway is part of the percussion impactor, one tooth section is followed by a base section, where the base section is essentially a constant distance from the FI end. Preferably the base section is inclined at a slope much less than the tooth section.

In an alternative preferred form, where the drive transmitter pathway is part of the outer casing, the drive transmitter pathway includes at least one lift section and at least one lead section. Preferably as you move along any one lift section the distance between the input side and the drive transmitter pathway increases, and as you move along any one lead section the distance between the input side and the drive transmitter pathway suddenly decreases to a minimum, one lift section followed by one lead section forms a tooth section. In an alternative preferred form, as you move along any one lift section the distance between the output side and the drive transmitter pathway increases, and as you move along any one lead section the distance between the output side and the drive transmitter pathway suddenly decreases to a minimum, one lift section followed by one lead section forms a tooth section.

Preferably the scalloped lead in section is incorporated into the variants where the drive transmitter pathway is incorporated into the outer casing. In preferred variations, where the drive transmitter pathway is part of the outer casing, the slope of the lift section can be variable and/or include scalloped sections.

Preferably one tooth section followed by one base section is a wave with a wavelength λ. Alternatively one tooth section is a wave with a wavelength λ.

Preferably the drive transmitter pathway includes from 2 to 1000 wavelengths. In a highly preferred form the drive transmitter pathway includes from 2 to 20 wavelengths.

Preferably there is a force unit in contact with the force input end that is configured to store energy as the or each drive transmitter moves along the lift section it is in contact with. Preferably when the or each drive transmitter passes into the lead section the stored energy is released into the percussion impactor accelerating it towards a percussion anvil which is part of the output section, upon contact with the percussion anvil some or all of the stored energy is transferred from the percussion impactor to the output section as a percussive impulse. Preferably the percussive impulse includes a rotational component.

In an alternative form the present invention provides a percussion device that includes:

an input side;
an output side;
at least one drive transmitter;
a drive transmitter pathway;
a percussion impactor; and
a percussion anvil;

where:

the drive transmitter pathway is a circumferential pathway around a longitudinal axis of the percussion device;
the drive transmitter pathway includes at least one tooth section including a lift section and a lead section;
the at least one tooth section is essentially one wavelength of a sawtooth wave;
the lift section is inclined away from a base of the drive transmitter pathway;
the lead section is a section of the tooth section which abruptly returns to the base of the drive transmitter pathway;
the input side is rotationally isolated from the percussion impactor;
the percussion anvil is attached to, or forms part of, the output side;
the percussion impactor includes an impact end and a force input end which are longitudinally opposite terminal ends of the percussion impactor; and
the impact end faces the percussion anvil;

such that:

when in use, and the output section is free to rotate, the at least one drive transmitter and the drive transmitter pathway are configured to act co-operatively to transfer the rotational motion of the input side to the output side; and
when in use and limited or no rotation of the output side is possible, the at least one drive transmitter and the drive transmitter pathway are configured to act co-operatively to increase, maintain or decrease the distance between the percussion impactor and the percussion anvil;

wherein the at least one drive transmitter and the drive transmitter pathway are configured to act co-operatively to accept rotational motion from the input side and transmit a percussive and/or rotational motion to the output side.

Preferably the percussion impactor is rotationally linked to the percussion anvil.

Preferably the output section includes an impactor shaft which is an elongate member extending above the percussion anvil and the percussion impactor includes an impactor shaft tunnel which is a longitudinally co-axially aligned void, such that the impactor shaft is a longitudinal sliding fit within the impactor shaft tunnel, wherein the impactor shaft and the impactor shaft tunnel are dimensionally configured to transmit rotational motion of the percussion impactor to the output section. Preferably the cross section of the impactor shaft and the impactor shaft tunnel are selected from the following list, rectangular, square, irregular polygon, regular polygon star shaped, cross shaped, oval, elliptical, lobed, any of the previously mentioned shapes with rounded corners (if present) and obround. Preferably the impactor shaft is longitudinally twisted. Preferably the twist is between $1/20^{th}$ and ¾ of a turn. More preferably between $1/20^{th}$ and ½ a turn.

Preferably the drive transmitter pathway is a continuous circumferential pathway. In an alternative form the drive transmitter pathway is a plurality of disconnected tooth sections, which in combination with spaces between said tooth sections form a continuous circumferential pathway.

Preferably the input side includes a casing which at least partially surrounds the percussion impactor and percussion anvil. Preferably the casing includes a force face, where said force face is an inner face of the casing that faces the force input end of the percussion impactor.

Preferably a force unit lies between the force face and the force input end. Preferably the force unit stores energy as it is compressed. Preferably the force unit is one or more devices independently selected from the following list a constant or variable rate compression spring, a constant or variable rate solid elastomeric spring, a constant or variable rate magnetic spring and a gas spring.

In one preferred form the drive transmitter pathway forms part of, or is attached to, the percussion impactor and the at least one drive transmitter is attached to a drive wall, where the drive wall is an inner wall of the casing.

In an alternative preferred form the at least one drive transmitter forms part of the percussion impactor and the drive transmitter pathway is attached to, or formed as part of, a drive wall, where the drive wall is an inward facing wall of the casing.

Preferably the at least one drive transmitter is a roller or a follower configured to slide or roll along at least part of the length of the drive transmitter pathway.

Preferably the lift section includes a scalloped indent.

Preferably the output section can be rotationally locked. Preferably when the output section is rotationally locked the percussion device imparts essentially percussive force to the output section.

Preferably the output section is attached to a drill string including a drill bit, or a drill bit.

Preferably the percussion device is used as part of a drilling rig.

In an alternative preferred form the percussion device is used to extract a jammed drill string or drill bit.

In an alternative form the percussion device is used to percussively drive a pile or casing into the ground or through a piece of material.

Preferably the at least one drive transmitter is configured to unload when it passes over an apex of a tooth section.

Preferably at least one tooth section is followed by a base section, where the base section is a space or a portion of the drive transmitter pathway. Preferably the base section is either:

essentially a constant distance from the force impact end, when the tooth section is attached to the percussion impactor; or
essentially a constant distance from an end of the casing, when the tooth section is attached to said casing.

In a preferred alternative the base section is inclined at a slope much less than the tooth section.

Preferably one tooth section followed by one base section is a wave with a wavelength λ. Alternatively one tooth section is a wave with a wavelength λ.

Preferably the drive transmitter pathway includes from 2 to 1000 wavelengths λ. In a highly preferred form the drive transmitter pathway includes from 2 to 20 wavelengths λ.

In any preferred or alternative variant the length of the base section, measured circumferentially, is between 0.5 and 4 times the length of the tooth section, measured circumferentially.

Preferably there are from 1 to 8 drive transmitters. In a highly preferred form there are 2 to 8 drive transmitters.

Preferably there is one tooth section for each drive transmitter.

BRIEF DESCRIPTION OF DRAWINGS

By way of example only, a preferred embodiment of the present invention is described in detail below with reference to the accompanying drawings, in which:

FIG. 29 is a side view of a further variant of the percussion assembly with the drive transmission pathway made up of a plurality of separate spaced apart tooth sections with the spaces between.

DEFINITIONS

Sawtooth: is a waveform that has an inclined section extending from a base to an apex which drops abruptly to the base after the apex. This term is intended to cover waveforms that are similar to breaking surf or otherwise include an undercut section below the apex, as well as waveforms which have sharp or rounded apexes and curved or linear inclined sections.

Shaft: a thin long piece of rigid material that turns or is turned to pass on power or movement to another part, it may have any cross-sectional shape appropriate for the purpose, it may be hollow (tube like) or a solid material:

Please note that where a range is provided it is intended that any sub-range falling within that range is also specifically covered, for example a range of 2 to 20 covers all ranges defined by the formula x to y where x is selected from 2 to 20 and y is selected from x to 20; 0.05 Hz to 500 Hz covers all ranges defined by the formula a to b where a=0.05 to 500 Hz and b=a to 500 Hz. The interval depends on what the range covers, if the range covers the number of objects present then it is likely the smallest division is one object so a range of 1 to 10 would be 1, 2, 3, 4, 5, 6, 7, 8, 9 and 10; if the range was for example a frequency range then it includes fractional parts down to the limitations of measurement.

Please note that the drawings are representative only and some of the relative dimensions or relative scales differ from that present in the preferred or optimum versions, this is for clarity reasons.

BEST MODE FOR CARRYING OUT THE INVENTION

Figure 1:
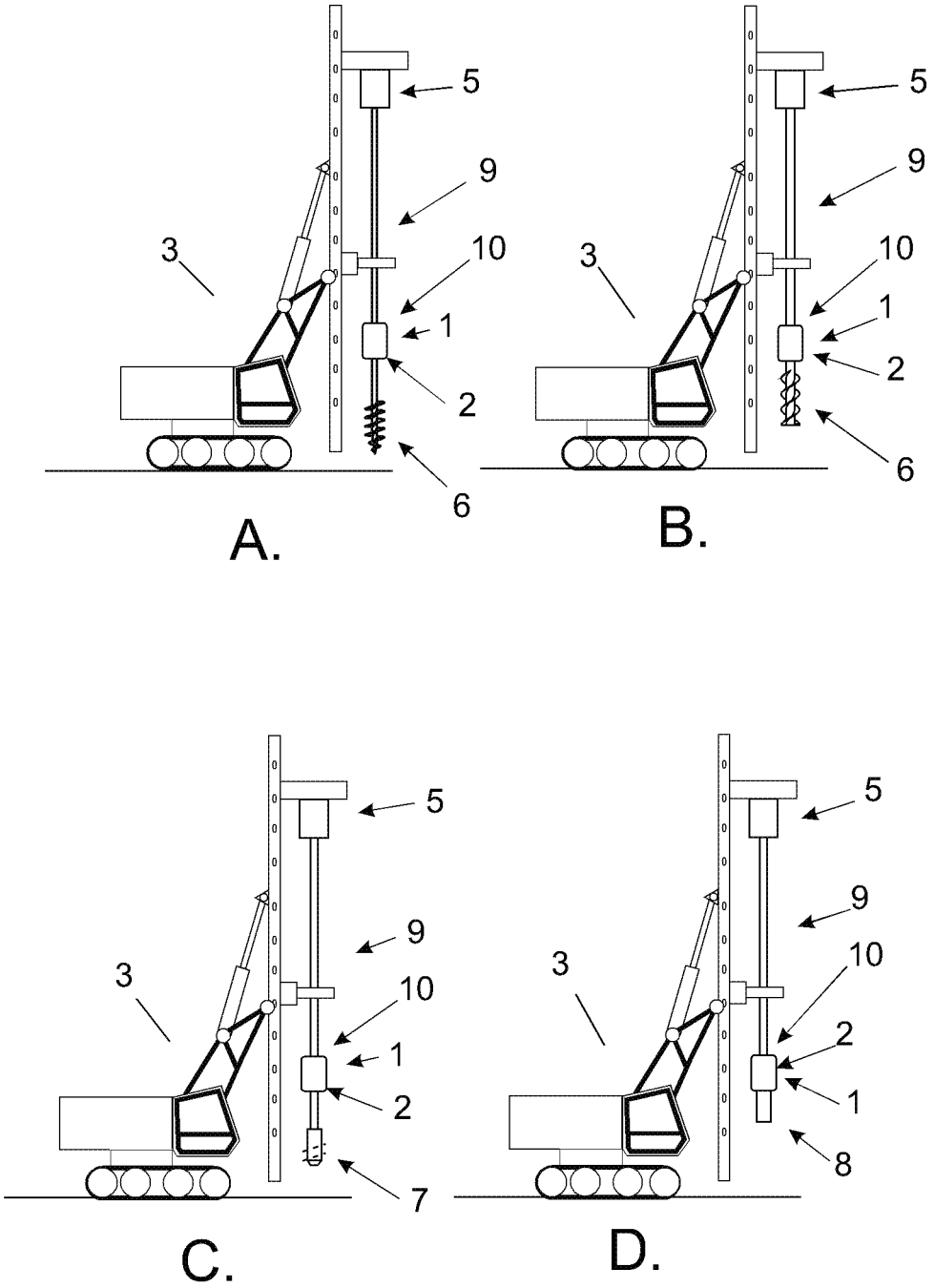
FIG. 1 is a series of 4 side views (A. to D.) of a drilling rig with the percussion device attached to drill or pile driver attached to a rig for a variety of uses.

Referring to FIG. 1 a percussion device (1) with an outer casing (2) is shown attached to a variety of drilling or pile driving solutions A., B., C. and D. each including a rig (3) with a main drive unit (5). The main drive unit (5) is most likely a motor (electric or hydraulic) and gearbox (usually present but not always), but it can be a motor alone or any other suitable type of drive unit (fixed speed, variable speed, electric, hydraulic, with or without gearbox). FIG. 1 A. and FIG. 1 B. show standard drills (6), FIG. 1 C. shows a twin concentric drill (7) similar to that described in U.S. Pat. No. 9,115,477 and FIG. D. shows a pile driver (8) using the percussion device (1) rather than traditionally used devices. The drill bits shown in FIG. 1 are representative only they can be any known form of roller cutter or fixed cutter type of drill bit including but not limited to twin, tri, quad (or a plurality of these) roller cone bits, blade/scraper/drag bits, Polycrystalline Diamond Compact (PDC) bits, diamond bits, percussion bits or variants and combinations of these. In use the main drive unit (5) rotates the drill string (9) prior to an input side (10) of the percussion device (1), thus rotating the outer casing (2).

Figure 2:
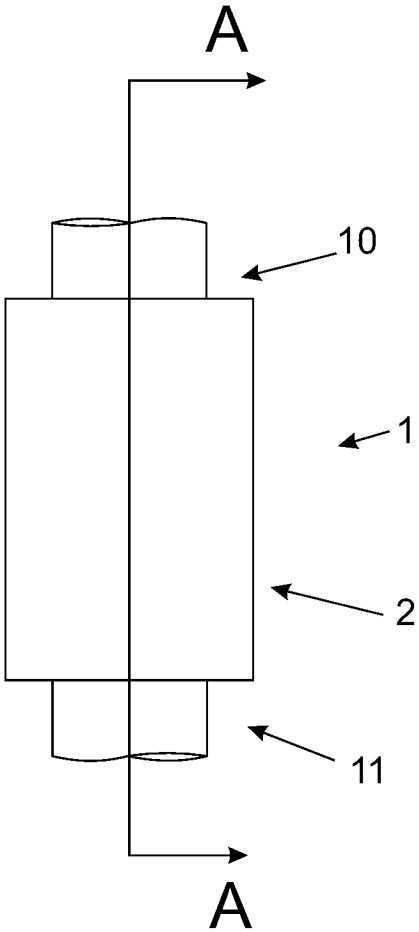
FIG. 2 is a side view of the percussion device.

Referring to FIG. 2 the percussion device (1) including an input side (10) and an output side (11) is shown with the outer casing (2) intact. In use the percussion device (1) translates the rotational motion applied directly or indirectly, to the input side (10) into percussive and/or rotational motion on the output side (11).

Figure 3:
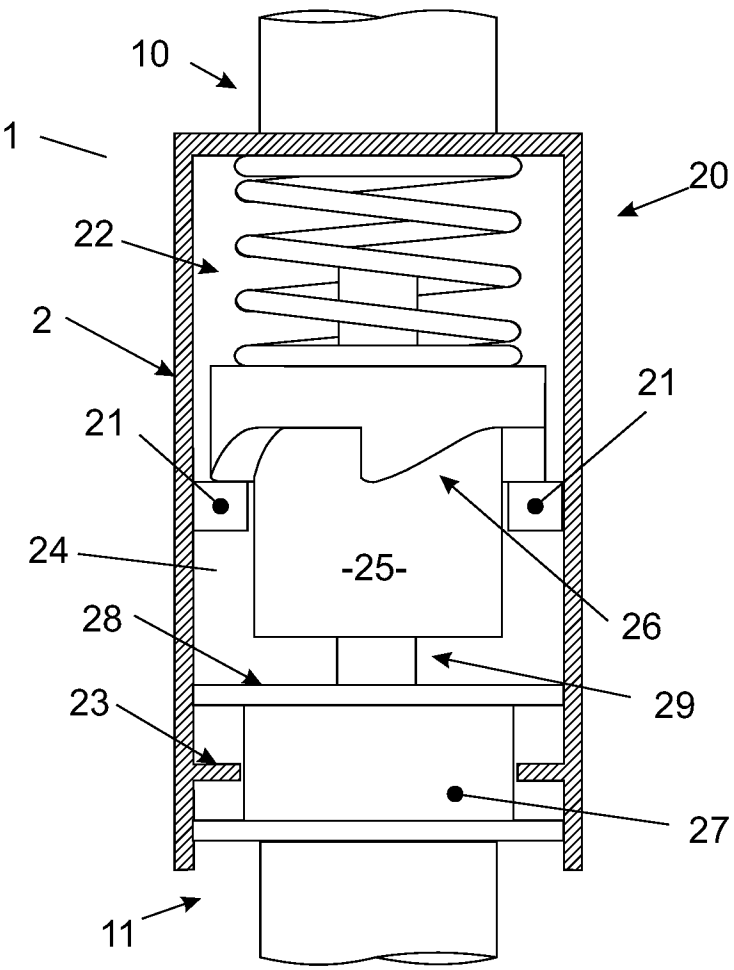
FIG. 3 is a cross sectional view, with the outer casing cut along the line A-A and viewed in the direction of arrows A-A, of the percussion device.

Referring to FIG. 3 a cross-sectional view of a first variant of the percussion device (1), with the outer casing (2) cut along the cut line A-A, viewed in the direction of arrows A-A in FIG. 2, is shown. The percussion device (1) includes:

- an input assembly (20) including the outer casing (2), drive transmitters (21), a force unit (22) and an alpha section (23);
- a percussion assembly (24) including a percussion impactor (25) with a drive transmitter pathway (26); and
- an output assembly (27) including a percussion anvil (28) and an impactor shaft (29).

Where the input assembly (20) is located on the input side (10) of the percussion device (1) and the output assembly (27) is located on the output side (11) of the percussion device (1).

Figure 4:
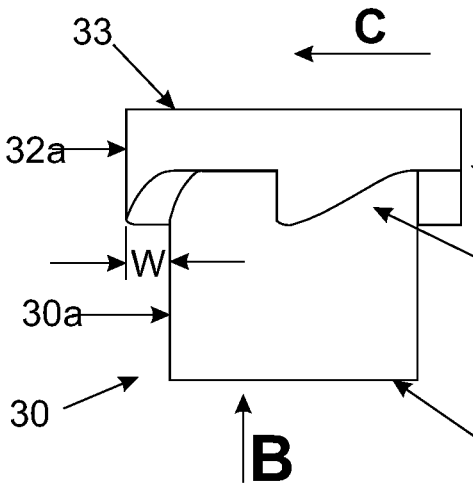
FIG. 4 is a side view of the percussion assembly separated from the percussion device.
Figure 5:
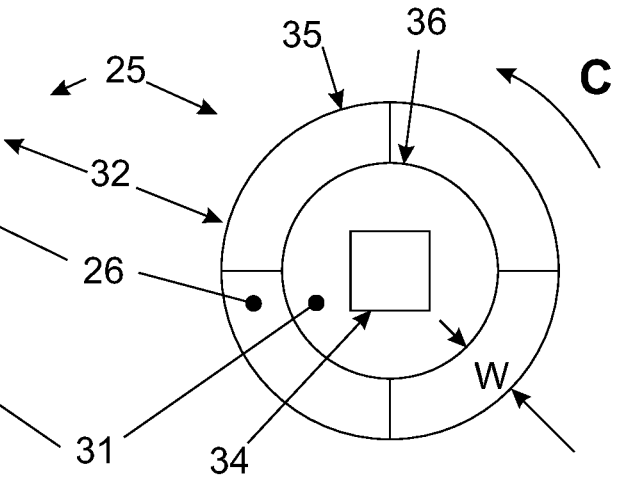
FIG. 5 is a view of the percussion impactor in the direction of the arrow B.

Referring to FIG. 4 and FIG. 5, where FIG. 5 is a view of the percussion impactor (25) in the direction of arrow B, the percussion impactor (25) is shown separated from the percussion device (1). The percussion impactor (25) includes:

- a first section (30) including an impact end (31);
- a pathway section (32) including a force input end (33), and
- an IS (Impactor Shaft) tunnel (34); where
- the impact end (31) and the force input end (33) are coterminous with the longitudinally opposite terminal ends of the percussion impactor (25); and
- the pathway section (32) includes the drive transmitter pathway (26).

The first section (30) includes a first section side surface (30*a*) (FS side surface (30*a*) for brevity) and the pathway section (32) includes a second section side surface (32*a*) (SS side surface (32*a*) for brevity). Where the side surfaces (35,36) are the exposed sides of the relevant section. The drive transmitter pathway (26) extends from the FS side surface (30*a*) to the SS side surface (32*a*) where the first section (30) and pathway section (32) are coterminous. The drive transmitter pathway (26) is a continuous path that encircles the percussion impactor (25). It is preferred, but not necessarily required, that the surface of the drive transmitter pathway (26), at any point along its path, lies on a plane perpendicular to the longitudinal axis of the percussion impactor (25).

The pathway section (32) is shown circular in cross-section with a diameter greater than the largest cross-sectional dimension of the first section (30). In this case the first section (30) is shown with a circular cross-section so the width (W) of the drive transmitter pathway (26) is constant around the percussion impactor (25) but, in some configurations, the cross sectional shape of the first section (30) will not be circular (it may be polygonal or oval for example).

The IS tunnel (34) is an open-ended void aligned with the longitudinal axis of the percussion impactor (25), with apertures at each terminal end of the percussion impactor (25). The cross-sectional shape and dimensions of the IS tunnel (34) are such that when engaged with the impactor shaft (29) the percussion impactor (25) can slide along a portion of the length of the impactor shaft (29). The complementary cross sectional shapes of the IS tunnel (34) and the impactor shaft (29) are such that there is minimal differential rotational motion between the percussion impactor (25) and the impactor shaft (29) when engaged. It is preferred that the percussion impactor (25) can freely slide along at least a portion of the length of the impactor shaft (29). In FIG. 5 the IS tunnel (34) is shown with a square or rectangular cross section.

The impact end (31), in this first variant, is a flat surface that lies on a plane perpendicular to the longitudinal axis of the percussion impactor (25).

The distance between the force input end (33) and the drive transmitter pathway (26) varies as you move along the length of the drive transmitter pathway (26). Moving along the drive transmitter pathway (26) in the direction of arrow C the distance between the force input end (33) and the drive transmitter pathway (26) increases then rapidly decreases and then remains the same until it increases again then rapidly decreases and then remains the same before repeating the pattern. The pathway waveform (75) is essentially a tooth with each tooth spaced apart. The number of rises for each full rotation of the percussion impactor (25) will vary but it is thought that it will be an even number (2 to 1000) and in use will result in a percussive frequency of between 0.1 to 150 Hz, though some applications may fall in the range of 0.05 Hz to 500 Hz.

The percussion impactor (25) is expected to be a dense rigid material, most likely metal and preferably one or more forms of steel. In this first variant the percussion impactor (25) is an essentially solid construction, but, it may, in certain configurations, include voids that can be filled with liquid materials to change the behaviour of the percussion impactor (25). For example the void could be partially filled allowing the liquid to move or the mass of the percussion impactor (25) could be adjusted whilst in use by adding or removing liquid. If mercury was used then the mass would be greater than a steel percussion impactor (25); the density of mercury is 13.5 tonne/$m^3$ and the density of steel is about 7.8 tonne/$m^3$.

Figure 6:
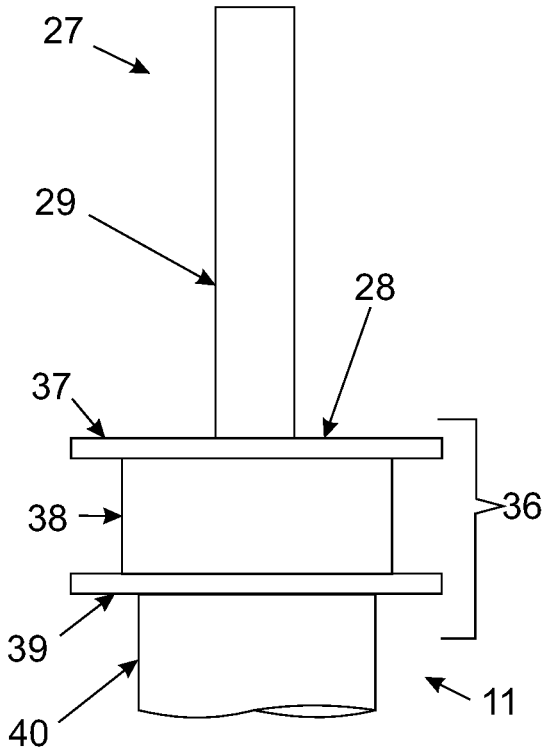
FIG. 6 is a side view of the output assembly shown removed from the percussion device.

Referring to FIG. 6 the output assembly (27) including the percussion anvil (28), the impactor shaft (29) and the isolation section (36) is shown separated from the percussion device (1) is shown. The isolation section (36) includes an isolation support (37) an isolator (38) and an isolation disc (39). The isolation support (37) and isolation disc (39) are separated by the isolator (38) forming an essentially 'I' shaped section. The outside diameter of the isolation support (37) and isolation disc (39) in this first variant is the same (though it need not be). The outside diameter of the isolation support (37) and isolation disc (39) in this first variant are both greater than the outside diameter of the isolator (38). The isolation disc (39) is attached to an output shaft (40) which forms part of the output side (11). The isolation support (37) includes, or is attached to, the percussion anvil (28). The longitudinal axis of the impactor shaft (29) is coaxial with the longitudinal axes of the output assembly (27), and it is attached to, and extends away from, the exposed surface of the isolation support (37) towards the input side (10).

Figure 7:
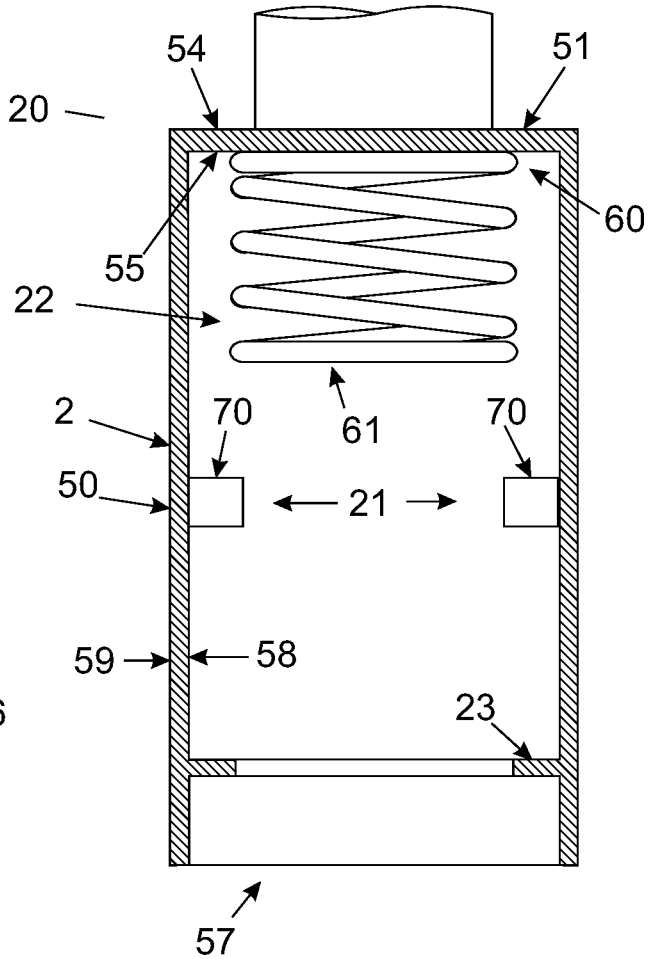
FIG. 7 is the cross sectional view shown in FIG. 3 with only the input assembly shown.

Referring to FIG. 7 the input assembly (20) is shown separated from the percussion device (1). In this first variant the outer casing (2) includes a body portion (50) and a base portion (51) where the body portion (50) is a tube, and the base portion (51) is a disc forming one terminal end of the outer casing (2). The base portion (51) includes an input face (54) and a force face (55). Where the input face (54) is coterminous with the exposed surface of the outer casing (2) and the force face (55) is the opposite face of the base portion (51) that engages, and/or is coterminous, with one end, the primary end (60), of the force unit (22).

The outer casing (2) includes an open terminal end, the open casing end (57), where the open casing end (57) and the base portion (51) are opposite terminal ends of the outer casing (2).

The outer casing (2) includes a drive wall (58) and an exposed casing wall (59), the exposed casing wall (59) is the face of the outer casing (2) that is coterminous with the exposed surface of the percussion device (1). The drive wall (58) and the exposed casing wall (59) are the opposite faces of the outer casing (2). The alpha section (23) is a flat ring of material attached to, and extending perpendicularly from, a portion of the drive wall (58) close to the open casing end (57), an annulus extending from the portion of the drive wall (58). When the percussion device (1) is in the assembled form the alpha section (23) lies between the isolation support (37) and the isolation disc (39), with a sliding or clearance fit between the alpha section (23) and the isolator (38). There is also a sliding or clearance fit between the drive wall (58) and both the isolation disc (39) and the isolation support (37).

The force unit (22) is shown as a coil spring, either constant rate or variable rate, extending from the force face (55). The force unit in this case is coaxially aligned with the outer casing (2). The force unit (22) includes the primary end (60) and a secondary end (61), with the primary end (60) and secondary end (61) being opposite terminal ends of the force unit (22). As previously indicated the primary end (60) is the end closest to the force face (55). The force unit (22) can include springs, pressurised gas (e.g. gas strut), magnetic sources with like poles closest, or a plurality of items independently selected from this list.

Figure 8:
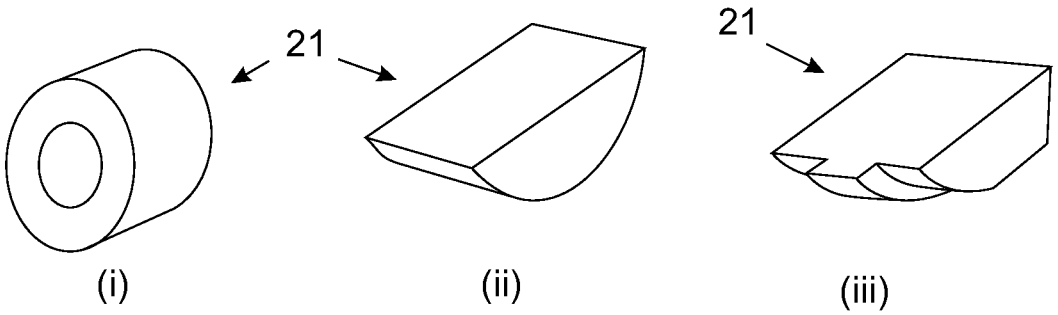
FIG. 8 is a series of different variants (i), (ii) and (ii) of a drive transmitter shown pictorially.

Referring to FIG. 3, FIG. 7 and, for the drive transmitter (21) shape, FIG. 8, two diametrically opposed drive transmitters (21) are shown, each is attached to, and extends from, the drive wall (58) towards the centre of outer casing (2). Each drive transmitter (21) includes a transmitter surface (70) which, when in use is in contact with the drive transmitter pathway (26). The drive transmitters (21) can be roller (as shown in FIG. 8(*i*)), a section of a disc with the curved surface forming the transmitter surface (70) (as shown in FIG. 8(*ii*)), or any other shape which, when the drive transmitter (21) is engaged with the drive transmitter pathway (26) the drive transmitter (21) can move along the drive transmitter pathway (26). For example the drive transmitter (21) may be a roller attached by an axle to the drive wall (58), the shape shown in FIG. 8(*ii*) either rigidly or via a pin which allows it to change orientation, a pin, or similar rotating, hinged or fixed devices. The drive transmitters (21) are shown as rollers in FIGS. 3 and 7.

Referring now to FIG. 3 where the percussion device (1) is shown in the assembled condition with the impact end (31) shown spaced apart from the percussion anvil (28). The percussion impactor (25) is engaged with the impactor shaft (29). The drive transmitter pathway (26) is engaged with the drive transmitters (21) at the point where there is the maximum distance between the drive transmitter pathway (26) and the force input end (33). The force unit (22) is engaged with the percussion impactor (25) and applying maximum force to the percussion impactor (25). The alpha section (23) is immediately adjacent the isolator (38) and spaced apart from the isolation disc (39). The dimensions of the isolator (38) and the alpha section (23) are such that they form a sliding joint.

The cross sectional shapes of the impactor shaft (29) and the IS tunnel (34) are complementary and do not allow differential rotational motion between them (unless the impactor shaft (29) has a longitudinal twist).

Figure 9:
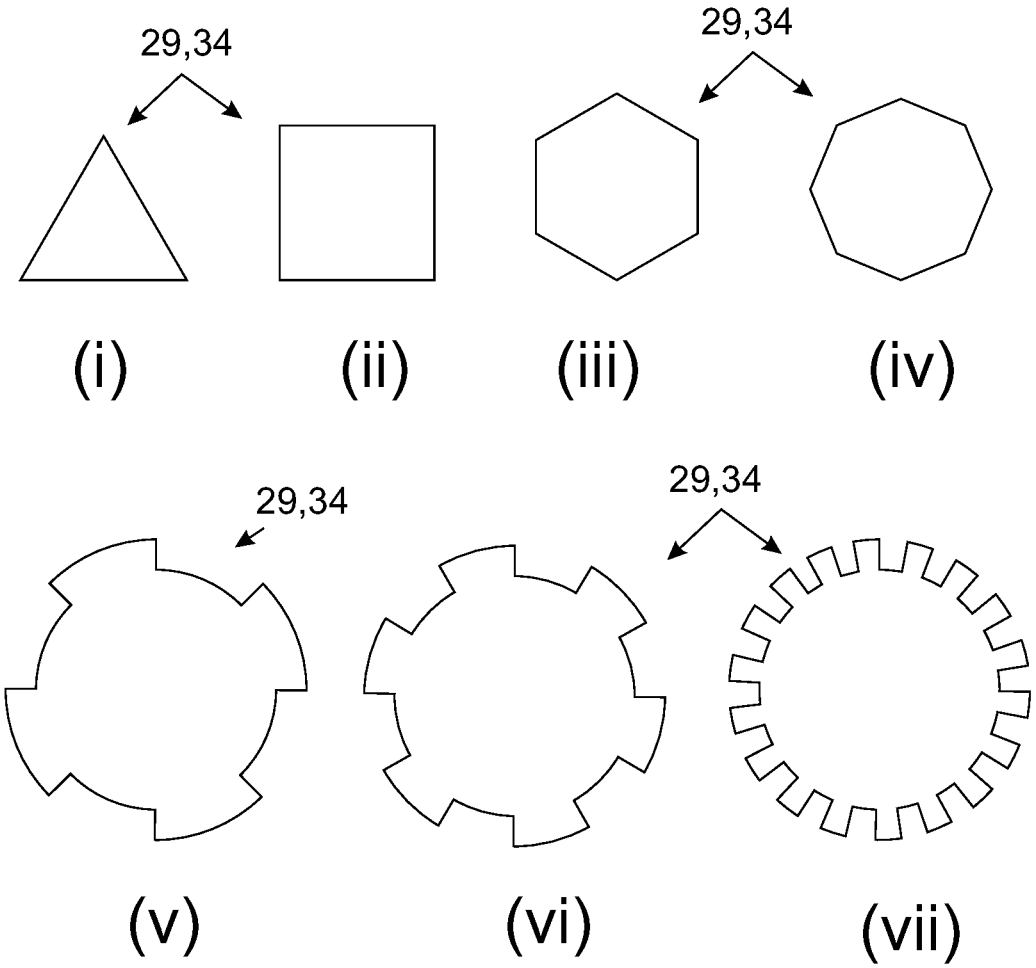
FIG. 9. is a series of cross sectional views (i) to (vii) of the impactor shaft or IS tunnel.

Referring to FIG. 9 (*i*) to (*vii*) some example cross sectional shapes for the impactor shaft (29) and IS tunnel (34) are shown, FIG. 9(*i*) to (*iv*) are three to 8 sided polygons (regular or irregular) and FIGS. 9(*v*) to 9(*vii*) are splined shafts/tunnels.

Figure 10:
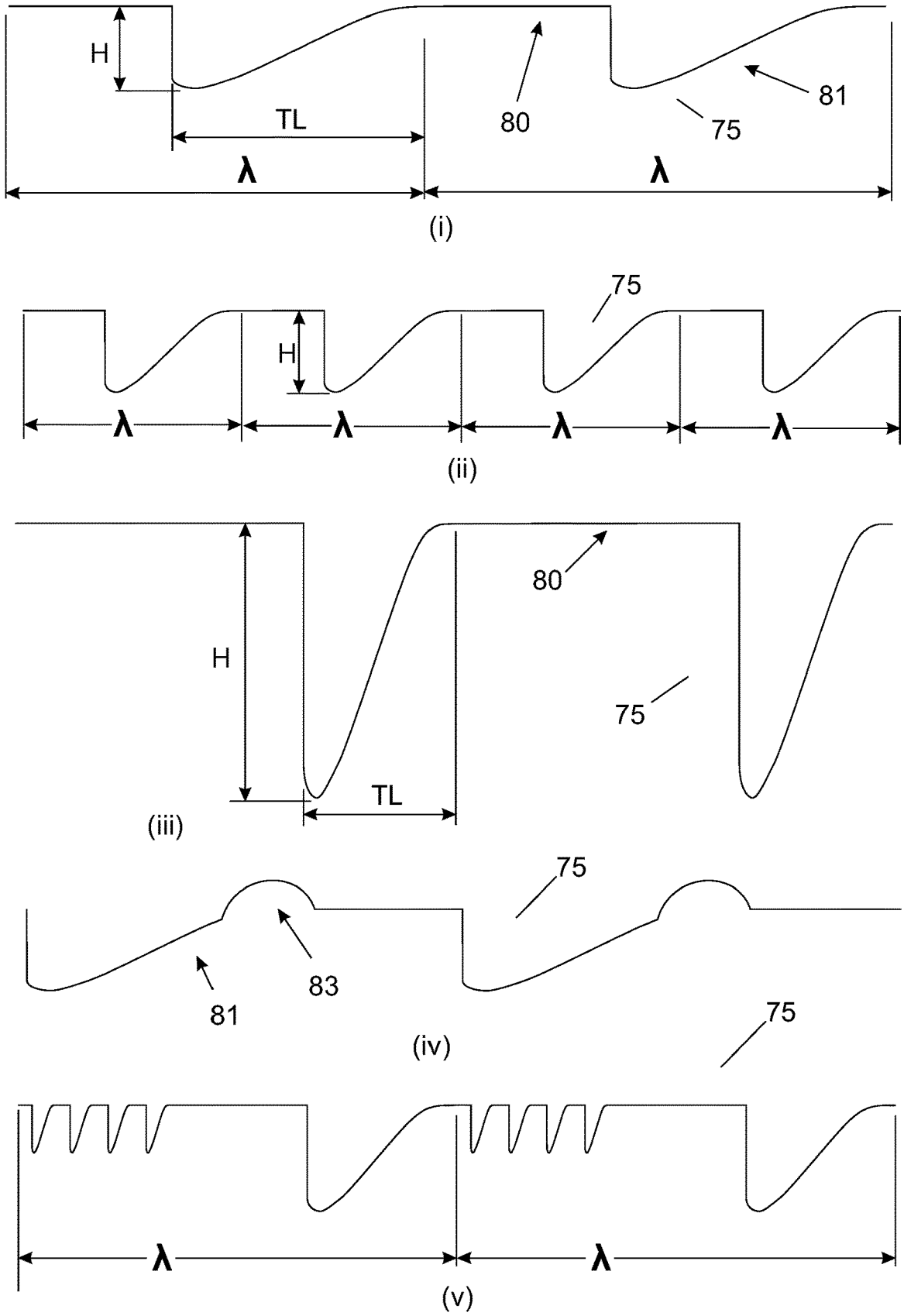
FIG. 10 is a series of waveforms which are a number of variants of the drive transmitter pathway, with the drive transmitter pathway flattened out.

Before describing this first variant of the percussion device (1) in use we will describe some variants of the drive transmitter pathway (26) by stretching it out and laying it flat so the pathway waveform (75) can be viewed. Referring to FIG. 10 (*i*) to (*v*) the drive transmitter pathway (26) waveform, the pathway waveform (75), is shown separated from the percussion impactor (25) oriented so that the FI end (33) (see FIG. 4) would be uppermost. In use the drive transmitter (21) would move right to left.

Referring to FIG. 10 (*i*) the pathway waveform (75) is shown consisting of two wavelengths (λ), each wavelength (λ) including a base section (80) and a tooth section (81). The base section (80) is shown about the same length as the tooth section (81). The tooth section (81) is essentially a right angle triangle with the base lying on the same line as the base section (80) and the right angle on the left hand side, with the exposed vertex being a smooth curve. The height (H) of the tooth section (81), the shortest distance from the base to the vertex, is shown as about 25% to 40% of the tooth length (TL). The pathway waveform (75) represents one complete rotation of the percussion impactor (25).

Referring to FIG. 10(*ii*) the pathway waveform (75) is similar to that shown in FIG. 10(*i*) but, consisting of four wavelengths (λ) with the height (H) about 45% to 65% of the tooth length (SL).

Referring to FIG. 10 (iii) the pathway waveform (75) is similar to that shown in FIG. 10(*i*) but the height (H) is approximately the same as the diameter of the pathway section (32) and the tooth length (TL) is about 30% to 40% of the base section (80).

Referring to FIG. 10 (*iv*) the pathway waveform (75) is shown with two wavelengths (λ) but the hypotenuse of the tooth section (81) commences with a scalloped out section (83).

Referring to FIG. 10 (*v*) the pathway waveform (75) is shown consisting of two wavelengths (λ) each consisting of four saw teeth and one large saw tooth to show that a combination of different size waves can be used.

It should be noted that the height (H) may be as low as 1 mm to 10 mm and up to the diameter of the pathway section (32) (though it may be necessary in some applications to extend this to two times the diameter of the pathway section (32)). The maximum diameter of the percussion device (1) is the diameter of the hole that the drill bit forms, the percussion impactor (25) will have a diameter less than this as it fits within the outer casing (2).

One preferred method of operation of the percussion device (1) will now be described with reference to any one of FIGS. 1 to 10, and more particularly 11 to 13.

Figure 11:
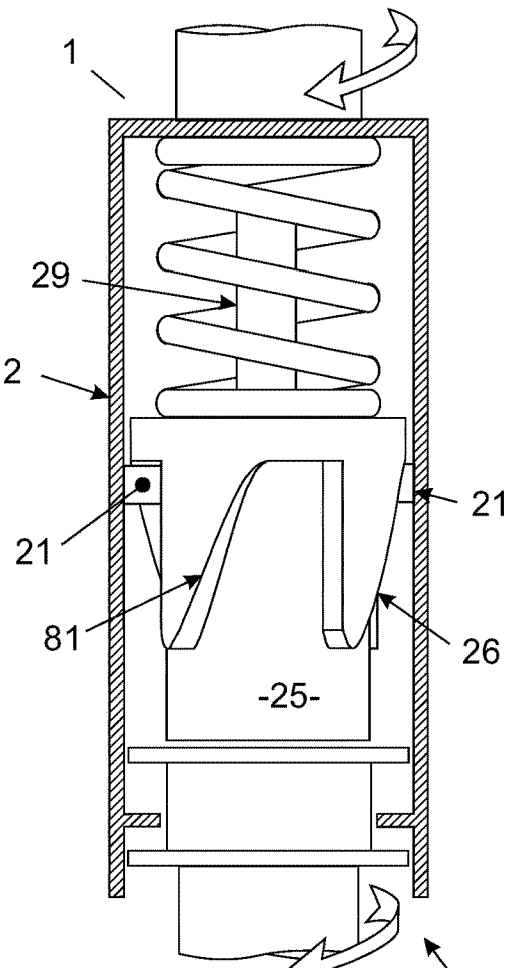
FIG. 11 is a cross sectional views similar to FIG. 3 with the percussion device in use with the output side rotating normally.

Referring to FIG. 11 specifically, and earlier drawings where required, a cross sectional view of the percussion device (1) in use with little or no resistance to rotation of the output assembly (27) present. The outer casing (2) is being rotated clockwise (left to right in the drawings) and the drive transmitters (21) have rotated around until they have contacted the tooth section (81) of the drive transmitter pathway (26) and started to apply force to the percussion impactor (25) which passes this rotational force onto the output assembly (27) via the impactor shaft (29). If the output assembly (27) is attached to a drill bit (not shown) then this may require some force to turn.

Figure 12:
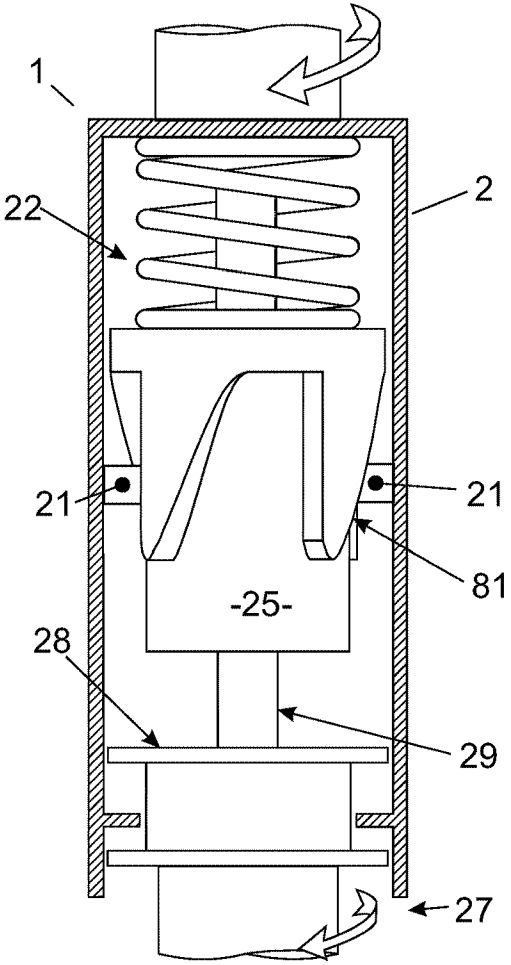
FIG. 12 is a cross sectional view similar to FIG. 11 with the percussion device in use with the output side meeting rotational resistance.

Referring to FIG. 12 specifically, and earlier drawings where necessary, a cross sectional view of the percussion device (1) in use with increasing resistance to rotation of the output assembly (27) present. As the resistance to rotation of the output assembly (27) the drive transmitters (21) climb up the tooth section (81), this occurs as the percussion impactor's (25) rotational velocity has slowed. This climb causes the percussion impactor (25) to move along the impactor shaft (29) away from the percussion anvil (28). This movement of the percussion impactor (25) causes the force unit (22) to store energy (if it includes a spring or pressurised gas then the spring and gas compress, if it includes like poles of magnets then it moves these together). This stored energy may reach a level where the resistance is insufficient to stop it being released, if this happens the output assembly (27) may experience an increased rotational velocity and possibly a minor percussive force as the percussion impactor (25) hits the percussion anvil (28). If the output assembly (27) continues to experience increased resistance, or is simply prevented from turning, then the drive transmitters (21) will continue to climb the tooth section (81) until they reach the vertex.

Figure 13:
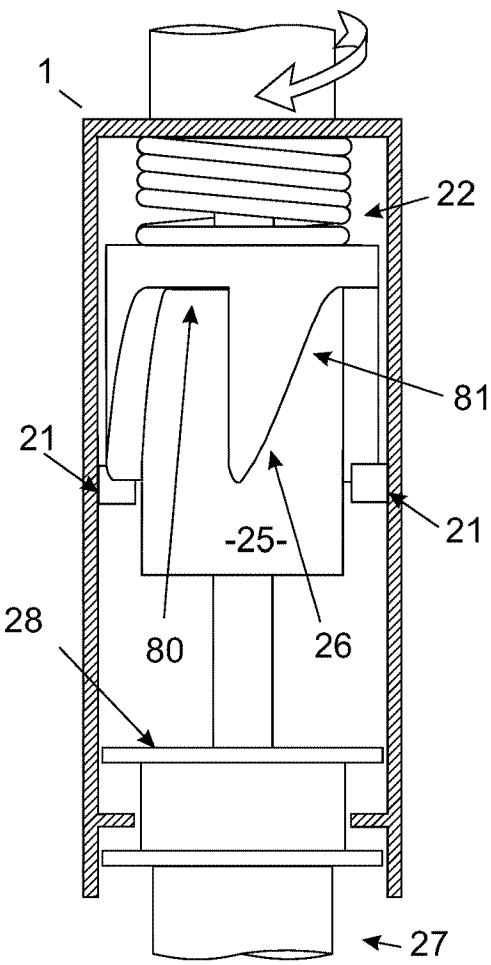
FIG. 13 is a cross sectional view similar to FIG. 12 with the percussion device in use with the output side still meeting rotational resistance with the energy stored within the force unit being released into the percussion impactor.

Referring to FIG. 13 specifically, and earlier drawings where necessary, a cross sectional view of the percussion device (1) in use with the drive transmitters (21) having passed over the vertex of the tooth section (81) and the force unit 22) releasing the stored energy into the percussion impactor (25). The resistance to the rotation of the output assembly (27) has continued and the drive transmitters (21) have been rotated past the vertex of the tooth section (81). As soon as the drive transmitters (21) clear the vertex of the tooth section (81) the percussion impactor (25) is free to move towards the percussion anvil (28) with the stored energy in the force unit (22) and any gravitational force to accelerate it. The percussion impactor (25) strikes the percussion anvil (28) transferring a percussive impulse to the output assembly (27). It should be noted that the drive transmitters (21) do not contact the base section (80) of the drive transmitter pathway ((26) at the time the percussion impactor (25) hits the percussion anvil (28). This may mean that the base section (80) is scalloped or cut away, or that the dimensions of the percussion impactor (25) are such that the base section (80) cannot contact the drive transmitters (21).

If the output assembly (27) is attached to a drill bit that has hit hard material and stopped this percussive impulse should clear it. The base section (80) puts a period of time between percussions which can be optimised for various drill and/or ground conditions. The intermittent percussive action when a drill is slowed by ground conditions to below a certain value is expected to improve penetration rates in certain problematic formations.

Figure 14:
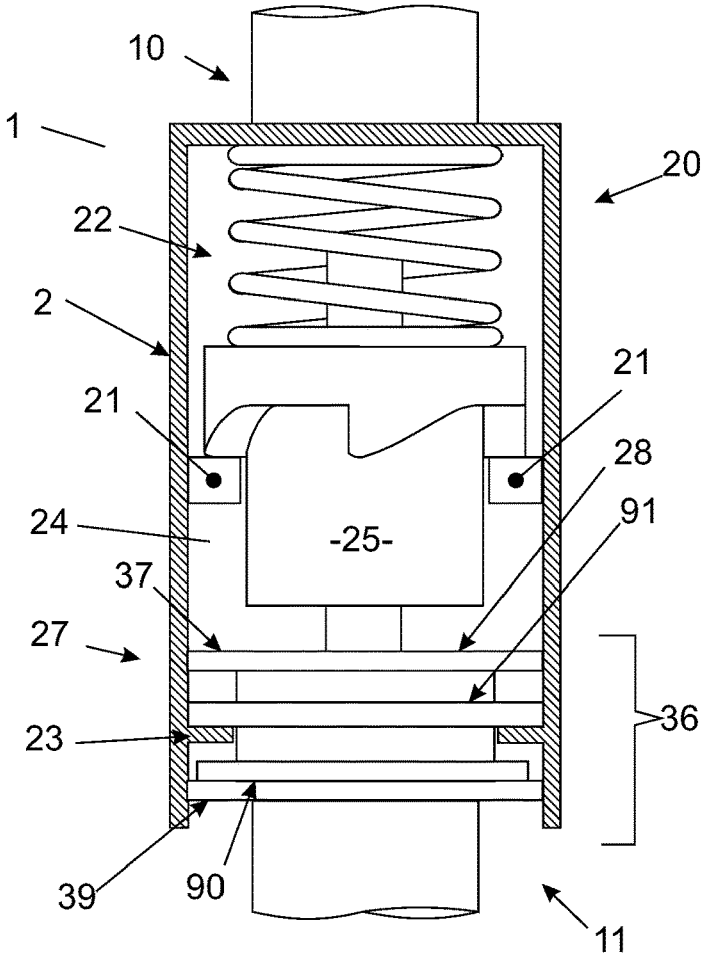
FIG. 14 is a cross sectional view, similar to that shown in FIG. 3, of a second variant of the percussion device.

Referring to FIG. 14 a second variant of the percussion device (1) is shown, this second variant includes an isolation buffer (90) between the alpha section (23) and the isolation disc (39). The isolation buffer (90) is a ring or annular piece of resilient material, for example an elastomeric material capable of absorbing all or part of a shock loading. Examples of suitable materials include rubber, natural or synthetic, foams or a combination of these, the isolation buffer (90) may be a sandwich of materials with a metal or hard plastic material facing an elastomeric core, with the elastomeric core being made up of one or more separately selected elastomeric materials. The isolation buffer (90) is present to minimise the differential movement allowed between the input and output sides (10,11) and/or prevent damage to the isolation section (36) if the percussive impulse generated by the percussion impactor (25) hitting the percussion anvil (28). In some configurations the isolation buffer (90) is a pressurised bladder, pressurised with a gas, this gas pressure can be varied to allow the distance the output assembly (27) can move in relation to the outer casing (2) to be set. This ability to set a predetermined maximum longitudinal movement could be used for the pile driving application where the distance a pile needs to be moved changes as it is driven into the ground.

An optional supplementary isolation buffer (91) is shown between the alpha section (23) and the isolation support (37); this is similar in configuration to the isolation buffer (90).

The isolation buffer (90) and the optional supplementary isolation buffer (91) are shown partially filling the gap, in some variants they may completely fill the gap.

In further configurations the isolation buffer (90) or supplementary isolation buffer (91), if present, includes, or is, a coil spring or annular magnets with like poles facing.

The supplementary isolation buffer (91) can, when present, act to isolate the percussion device (1) from impacts and other impulse forces applied by the components downstream of the output side (11). For example if the percussion device (1) is attached to a drill bit (not shown) that impacts hard material causing it to bounce this impulse can be damped.

Properly dimensioned the isolation buffer (90) and the optional supplementary isolation buffer (91) can seal against the surface of the isolator (38) to minimise or eliminate the ingress of material into the interior of the percussion device (1).

Figure 15:
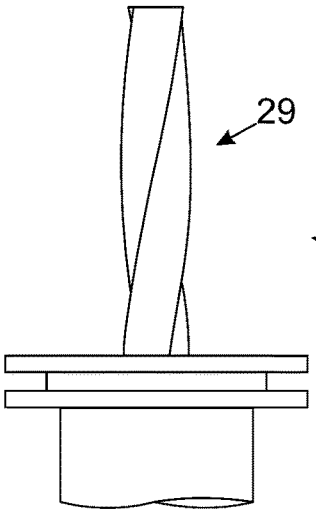
FIG. 15 is a side view of a variant of the output section which has a helically twisted impactor shaft.
Figure 16:
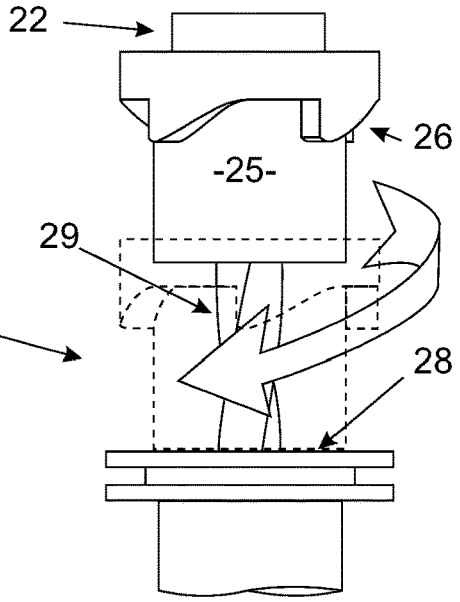
FIG. 16 is a side view of the variant output section with a percussion impactor at the point where the force unit is discharging the stored energy into the percussion impactor.

Referring to FIG. 15 (and other previous figures where required) a variant of the output assembly (27) which includes an impactor shaft (29) with a helical twist is shown. The twist shown is approximately ¼ turn but it is believed that in practice $1/20^{th}$ to ½ a turn, inclusive, will be the acceptable range. With this variant output assembly (27) used the percussion impactor (25) will rotate backwards (against the direction of rotation of the outer casing (2)). Referring to FIG. 16 a percussion impactor (25) is shown at the moment when the energy stored in the force unit (22) is released, the percussion impactor moves along the impactor shaft (29) rotating forwards in the direction of the arrow as it does so. When the percussion impactor (25) (shown in dashed lines) hits the percussion anvil (28) it imparts a rotational percussive impulse. It is believed that this rotational percussive impulse will clear stalled drill bits and in some instances drive piles more effectively or drill faster in certain formations. The optimum range for the twist is likely to be $1/20^{th}$ turn to $1/6^{th}$ turn.

With a twist the vertical section of the drive transmitter pathway (26) could contact the drive transmitters (21) (not shown in FIG. 16, see FIG. 11-13 for example). To prevent this contact the vertical section will be cut away so that it does not make contact.

Figure 17:
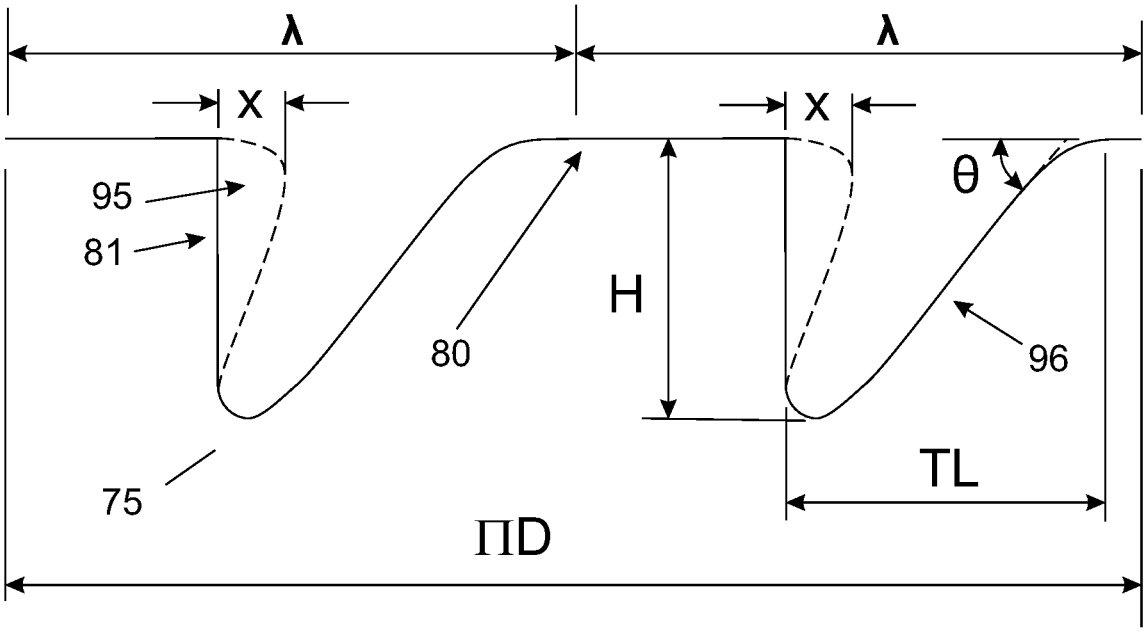
FIG. 17 is a view of an alternative two wavelength pathway waveform (75) for the drive transmitter pathway, with the vertical section of the tooth section cut back to allow for the variant twisted impactor shaft.

Referring to FIG. 17 a modified drive transmitter pathway (26) pathway waveform (75) with two wavelengths (λ) is shown. In this modified pathway waveform (75) the tooth section (81) of the pathway waveform (75) has the same basic shape as that described earlier, but, the lead section (95) of the tooth section (81) has been scalloped (shown as a dashed line), into a distance (x) so that the drive transmitters do not contact the lead section (95) as the percussion impactor (25) rotates along the impactor shaft (29) when the stored energy in the force unit (22) is released. The lead section (95) is the portion of the tooth section (81) that in a plain sawtooth wave is perpendicular to the base. The portion of the tooth section (81) that the drive transmitters (21) (shown in dashed lines) climb is the lift section (96). The length of the waveform (πD) is two wavelengths (λ) with the wave height (H) about the same as the tooth length (TL), where the tooth length (TL) is the length of the tooth section (81). The base section (80) is about the same length as the tooth section (81). The angle of the lift section (96) of the tooth section (81) to the base section (80) is θ, noting that this angle is simply a line along the average (mean) slope of the lift section (96).

Figure 18:
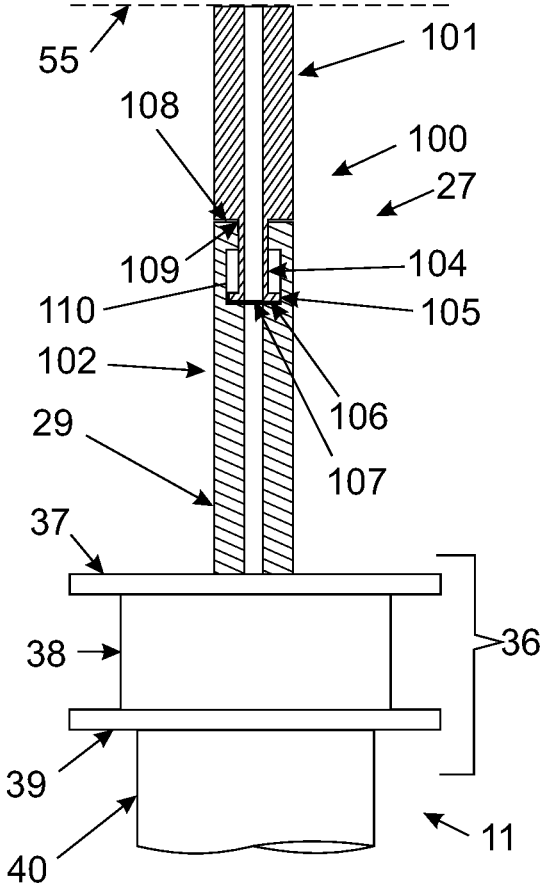
FIG. 18 is a side view of the output section with a variant of the impactor shaft shown in cross section.

Referring to FIG. 18 a variant of the output assembly (27) including an impactor shaft (29) with a sliding joint (100) that allows a fluid to be passed through the centre of the impactor shaft (29) is shown. In this case the impactor shaft (29) extends from the force face (55) (shown as dashed line) to the isolation support (37). This variant of the impactor shaft (29) includes a primary shaft (101) and a secondary shaft (102) where one terminal end of the primary shaft (101) is coterminous with the force face (55) and one terminal end of the secondary shaft (102) is coterminous with the isolation support (37). The primary and secondary shafts (101,102) each include an open ended fluid pathway extending along their longitudinal, co-axially aligned, axes.

The primary shaft (101) includes a primary reduced section (104) and primary expanded end (105), the primary reduced section (104) is a length of the primary shaft (101) that has a smaller outside diameter than the minimum cross sectional dimension of the remainder of the primary shaft (101). The primary expanded end (105) is the terminal end of the primary shaft (101) most distant from the force face (55) and the primary reduced section (104) is immediately adjacent to the primary terminal end (106). The primary expanded end (105) is an annulus with a primary shaft hole (107).

The secondary shaft has a tau terminal end (109) where the tau terminal end (109) is the terminal end of the secondary shaft (102) furthest from the isolation support (37). The tau terminal end includes a tau aperture (109) which is a circular aperture dimensioned to accept the primary reduced section (104) but too small to allow the primary expanded end (105) to pass through. The tau aperture is a pathway to a cylindrical void within the secondary shaft (102), a connection void (110). The diameter of the connection void (110) is greater than the diameter of the tau aperture (109). The primary reduced section (104) sits within the tau aperture (109) and the primary expanded end (105) sits within the connection void (110). The dimensions of the primary expanded end (105) and the connection void (110) are such that they form a sliding fluid tight seal that rotationally isolates the primary shaft (101) from the secondary shaft (102). The length of the primary reduced section (104) and the connection void (110) allows the length of the impactor shaft (29) to change whilst the fluid seal and rotational isolation remains. This variant of the output assembly (27) could also incorporate any of the known means of providing a fluid pathway that rotational isolates a primary shaft (101) and a secondary shaft (102) whilst allowing differential longitudinal movement and maintaining a fluid seal.

Figure 19:
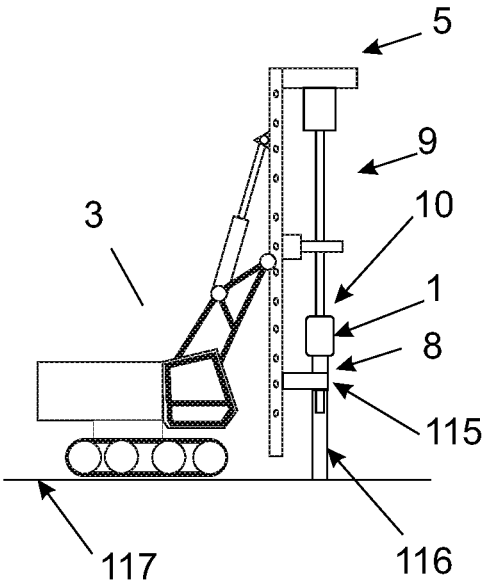
FIG. 19 is a side view of a rig with the percussion device used as a pile driver.

Referring to FIG. 19 the pile driving variant is shown with a locking device (115) attached, this locking device (115) prevents the output assembly (27) from turning, this locks the percussion device (1) so that it provides only a percussive impulse output (no rotation) to drive a pile (116) into the ground (117). The locking device (115) may simply be a brake drum/disc, engage a pin into an aperture, be a magnetic locking clutch, or anything similar; the locking device (115) simply reduces or stops the rotation of the output shaft (40). The locking device (115) is shown connected to the output side (11) of the percussion device (1) as this is where it is required. The locking device (115) may be permanently on, or be able to be engaged fully or partially when necessary. For a permanently 'on' percussion device (1) the output assembly (27) or output shaft (40) could be rigidly attached to the rig (3).

Figure 20:
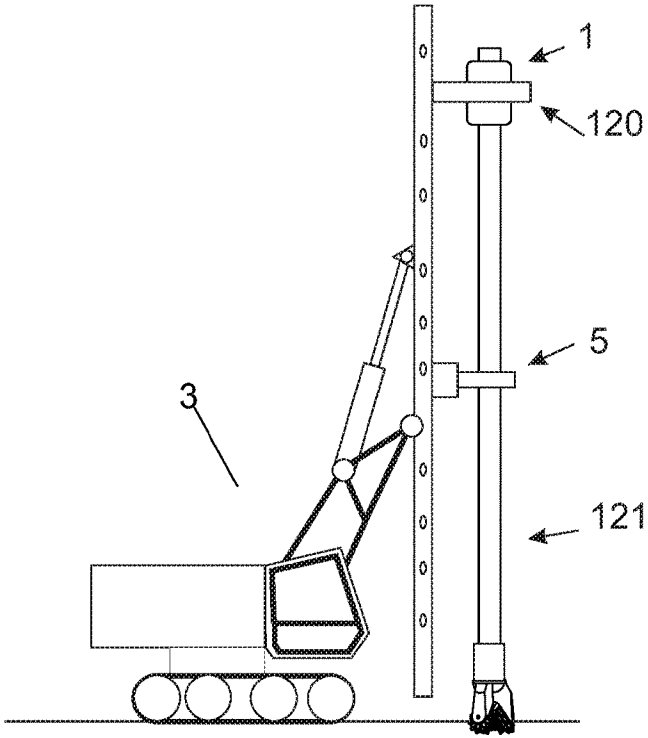
FIG. 20 is a side view of a rig with the percussion device driven by a separate drive unit.

Referring to FIG. 20 an alternative configuration with the percussion device (1) driven by a separate percussion drive unit (120), for example a motor or motor/gearbox unit that drives only the percussion device (1), is shown attached to a rig (3). The percussion device (1) in the configuration shown is above the main drive unit (5). In this configuration, to prevent percussive damage to the main drive unit (5), additional damping or percussive isolation may need to be added. The percussion device (1) could turn with the drill (121) but when percussive impulses were required the percussion drive unit (120) would be engaged. The percussion drive unit (120) would have a higher rotational velocity than the drill (121) causing the percussion device (1) to operate. The force unit (22) (see earlier drawings) would need to be sized so that rotational impulses applied by the percussion device (1) did essentially no damage to the main drive unit (5).

Figure 21:
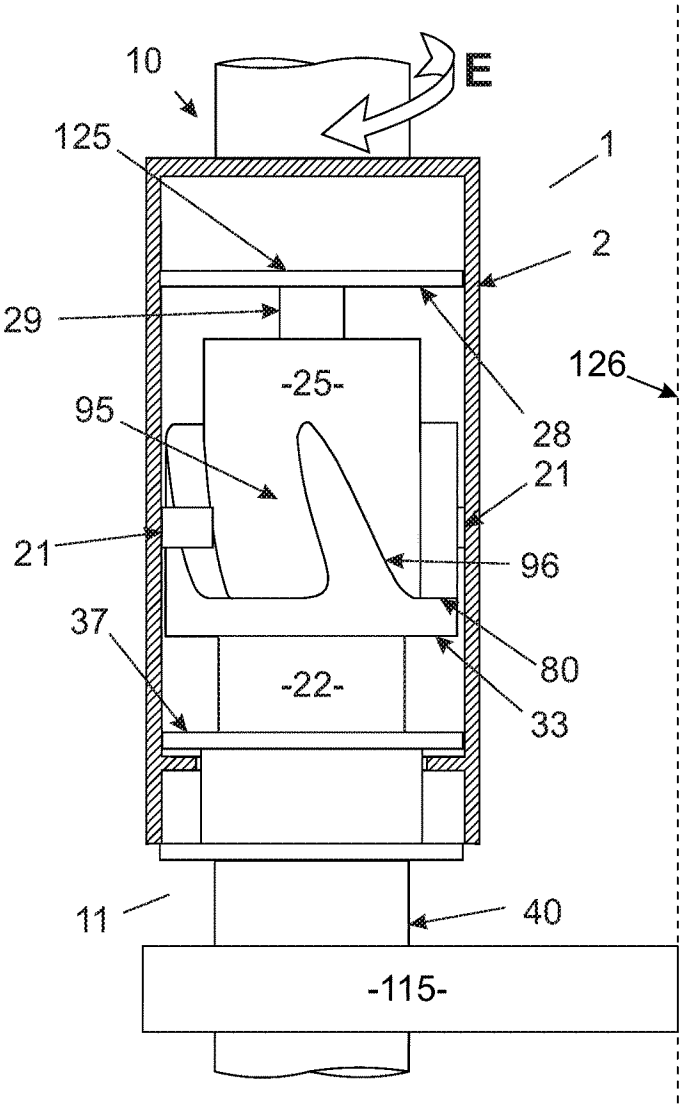
FIG. 21 is cross sectional view, with the outer casing cut along the line A-A and viewed in the direction of arrows A-A, of an extraction variant of the percussion device.

Referring to FIG. 21 an extraction variant of the percussion device (1) is shown, in this extraction variant the percussion device (1) is configured to generate a percussive impulse pulling the output side (11) towards the percussion device (1). This form of the percussion device (1) includes a locking device (115), similar to that described earlier. The locking device (115) is attached to the mast (126) (shown in dashed lines) of the rig (3), this locking device (115) allows the output side (11) to be locked to prevent rotation.

In the extraction configuration the percussion impactor (25) is inverted and the force input end (FI end) (33) is located adjacent to the isolation support (37), with the force unit (22) separating the isolation support (37) and percussion impactor (25).

The impactor shaft (29) includes a shaft terminal end (125), which is the terminal end of the impactor shaft (29) that is not attached to the isolation support (37). In this extraction variant the percussion anvil (28) is a disc that is coterminous with the shaft terminal end (125).

In operation the outer casing (2) is turned in the direction of arrow E, and the output shaft (40) is locked (prevented from rotating) by the locking device (115). The drive transmitters (21) move along the base section (80) up the lift section (96) storing energy in the force unit (22). The drive transmitters (21) pass over the vertex into the lead section (95) releasing the energy stored in the force unit (22) which accelerates the percussion impactor (25) towards the percussion anvil (28). The percussion impactor (25) hits the percussion anvil (28) transferring a percussive impulse to the impactor shaft (29) which transfers this percussive impulse to the output shaft (40). This percussive impulse is transferred to the object (not shown) to be extracted, which could be a pile, a drill bit, or a drill string or any components of that drill string.

Figure 22:
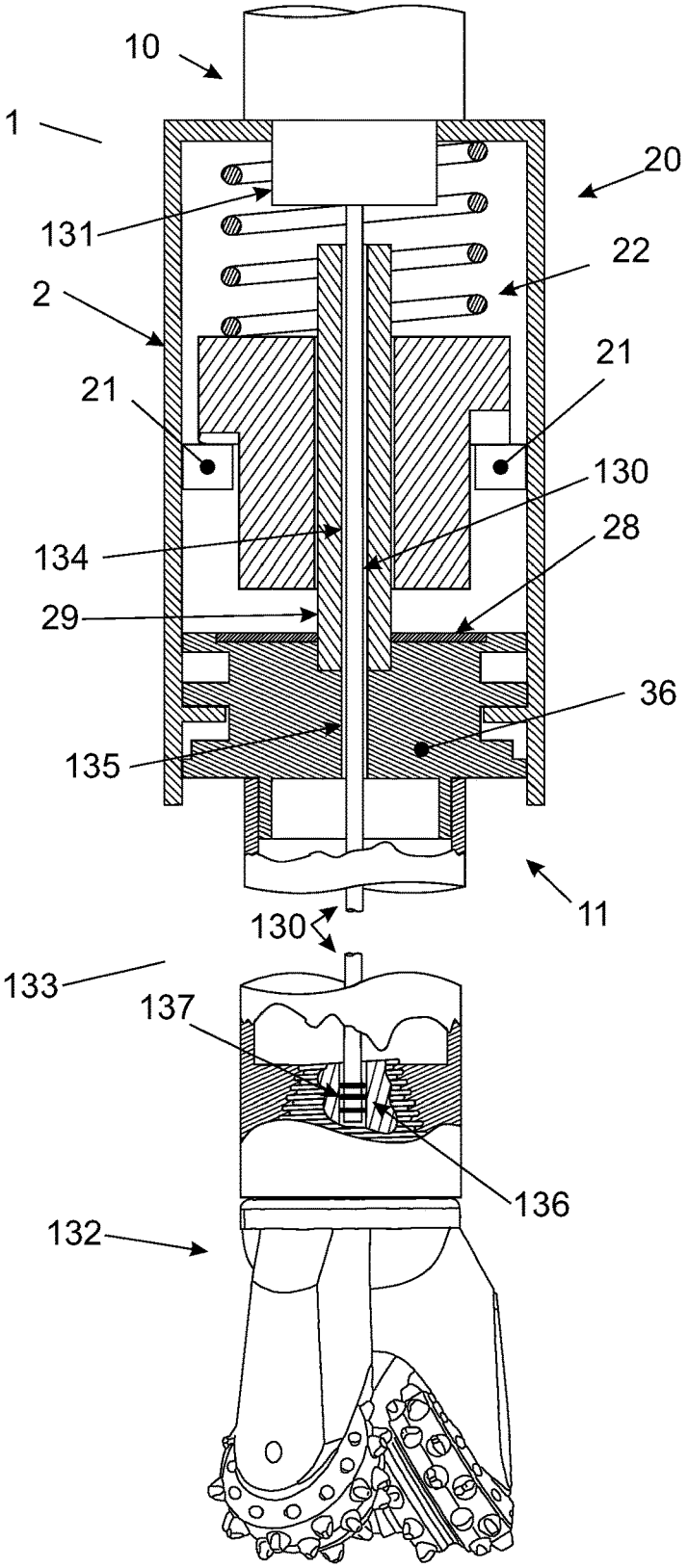
FIG. 22 is a partial cross sectional view of the drill string from the percussion device to the drill bit, with the casing cut along the line A-A and viewed in the direction of arrows A-A and the drill bit partially sectioned, of an alternative variant allowing fluid delivery to the drill bit.

Referring to FIG. 22 a further variant that allows a fluid to be fed through the percussion device (1) is shown, with the percussion device (1) shown in sectional view except for a fluid conduit (130) and swivel (131). FIG. 22 also shows a drill bit (132) attached to the end of a drill string (133), the drill bit (132) shown is a tri-cone rock drill but any drill bit (132) could be present.

The swivel (131) is a standard piece of equipment used for drills that provides a pathway for a material to be introduced into a rotating portion of the drill string (133) from a static point, or it allows a component within the drill string (133) to be isolated from the rotation of other components. In this case the swivel (131) provides a pathway for the fluid conduit (130) to pass through the outer casing (2) into the percussion device (1) interior.

The fluid conduit (130) is a tube or other form of hollow elongate member that provides a pathway for a fluid introduced above ground to be fed to the drill bit (132), or part of the drill string (133) below the percussion device (1).

The fluid conduit (130) passes through an impactor pathway (134) which is a centrally aligned open ended hole through the impactor shaft (29), the impactor pathway (134) being dimensioned and configured to allow the fluid conduit (130) to be rotationally isolated from the impactor shaft (29). The fluid conduit (130) also passes through an output pathway (135) which is a centrally aligned open ended hole through the isolation section (36). The output pathway (135) being dimensioned and configured to allow the fluid conduit (130) to be rotationally isolated from the isolation section (36). The fluid conduit (130) then passes down the drill string (133) below the percussion device (1) to the drill bit (132). The fluid conduit (130) is connected to the drill bit (132) by a bit sliding joint (136). The bit sliding joint (136) allows the fluid conduit (130) to feed a fluid into the drill bit (132), or drill string (133) below the percussion device (1), whilst still rotationally isolating the fluid conduit (130) on the input side (10) from the drill bit (132). The bit sliding joint (136) allows fora certain amount of horizontal or co-axial longitudinal movement between the drill bit (132) and the terminal end of the fluid conduit (130), whilst maintaining a fluid seal, this may be accomplished in a similar manner to that shown in FIG. 18 or one or more sealing rings (137) could be attached to the fluid conduit (130). There are many ways of providing this bit sliding joint (136) and any one of them can be used. In some variants the void within the fluid conduit (130) may be coterminous with the output pathway (135) and the swivel (131) rotational isolates the fluid conduit (130) on the input side (10) from the fluid conduit (130) on the output side (11). In further variants the fluid conduit (130) is twinned with the drill bit (132).

Figure 23:
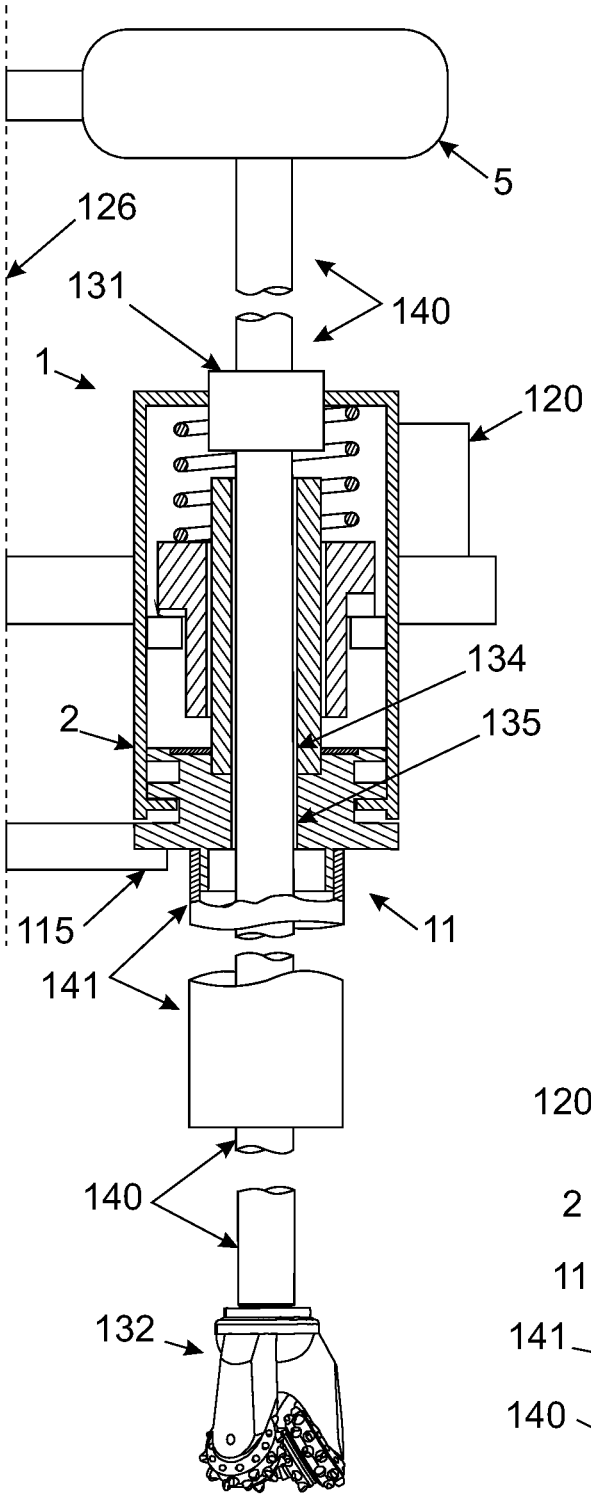
FIG. 23 is a partial cross sectional view of a drill string, with the casing cut along the line A-A and viewed in the direction of arrows A-A, including the percussion device for use as a casing driver.
Figure 24:
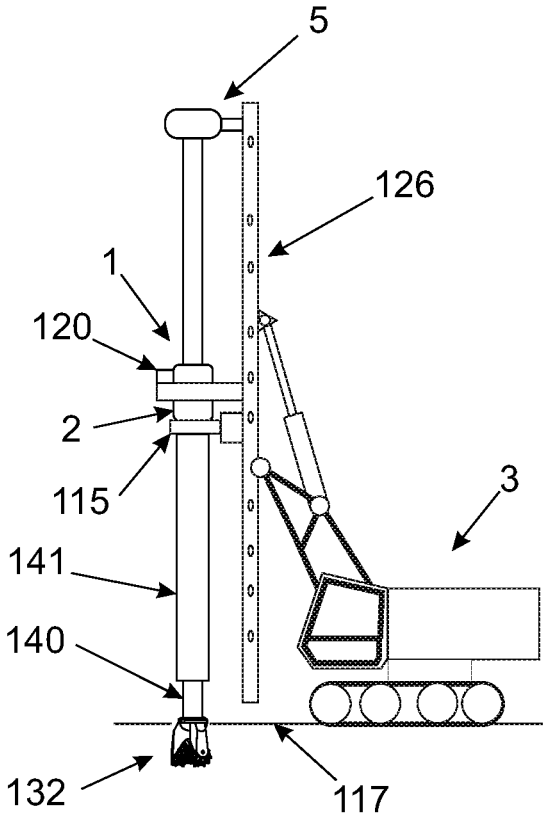
FIG. 24 is a pictorial view of a rig with a drill string with the percussion device configured as a casing driver.

Referring to FIGS. 23 and 24 the percussion device (1) is shown in use as a casing hammer/driver. In this variant the main drive unit (5) is attached towards the top of the mast (126) and in use it drives an inner drill string (140) which passes through a swivel (131), an impactor pathway (134), an output pathway (135) and the casing (141) being driven. The drill bit (132) is attached to a terminal end of the inner drill string (140) distal from the main drive unit (5). The percussion device (1) is rotationally isolated from the inner drill string (140) and not able to be directly rotated by the main drive unit (5).

The percussion device (1) is attached to a percussion drive unit (120) that, in use, allows the outer casing (2) to be rotated. A locking device (115) that can rotationally lock the output side (11) of the percussion device (1) is attached to the mast (126) and the percussion unit (1).

In use the main drive unit (5) drives the drill bit (132) rotationally and the rig (3) inserts it into the ground (117). When the casing (141) is to be driven into the ground (117) the output side (11) of the percussion device (1) is engaged with an end of the casing (141), the percussion drive unit (120) and locking device (115) are engaged to generate percussive impulses. The percussive impulses from the percussion device (1) are transferred to the casing (141) which assists in driving the casing (141) into the ground (117).

In this variation the percussion operation can be turned on and off by locking/unlocking the output shaft (4) which allows extra casing sections to be inserted and control the rate of casing (141) installation; and/or by engaging or disengaging the percussion drive unit (120).

Figure 25:
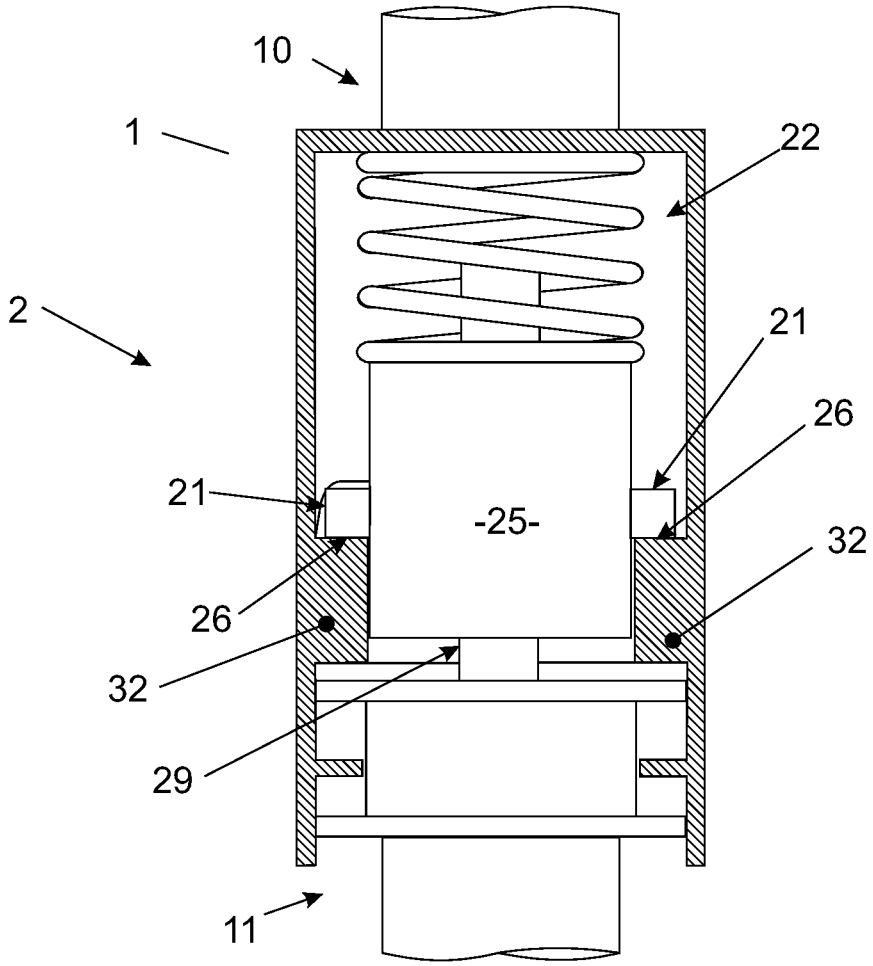
FIG. 25 is a cross sectional view, with the casing cut along the line A-A and viewed in the direction of arrows A-A, of a further variant of the percussion device where the pathways section is part of the outer casing and the drive transmitters are attached to the percussion impactor.

Referring to FIG. 25 a further variant of the percussion device (1) is shown as a partial cross sectional view similar to that in FIG. 3, in this variant the pathway section (32) is part of the outer casing (2) rather than the percussion impactor (25). In this variant the drive transmitters (21) are attached to the first section (30) of the percussion impactor (25). The operation of the percussion impactor (25) is the same as previously described, as such this configuration can be used in any of the previously described variants without significant changes to the remaining components.

Though described with reference to a drilling rig (3) for drilling holes into the ground the percussion device (1) can be used with smaller power tools to provide a percussive impulse when drilling holes in hard or specific materials. In addition the percussion device (1) can be used in any suitable application which requires the conversion of a rotational motion to a percussive and/or rotational motion.

Expected Ranges

Where the ranges include the terminal figures, of operational parameters for a drilling rig (3), using any of the variants or combinations of the variants:

Number of wavelengths per complete rotation of the percussion impactor (25)=1 to 40, preferably an even number from 2 to 20. Smaller diameter applications may extend this range to 1 to 1000, but this is yet to be confirmed and some may not be practical.

Height (H)=2×the diameter of the drill bit to 1 mm, preferably about the diameter of the drill bit to 5 mm. If there is no drill bit then the range is 1.2 m to 1 mm. Between 100 mm and 900 mm is expected to be most useful for drilling operations.

Rotational velocity (in rpm)=1 rpm to 50 rpm for drills above about 600 mm in diameter and 4 to 1200 rpm for drills below about 600 mm in diameter. For extraction and pile driving applications the frequency and/or the percussive impulse force will determine the acceptable range. For smaller power tools the rotational velocity is determined by the application, for example a power drill with a tungsten carbide drill being used for concrete drilling will be different to a high speed drill being used for drilling wood, metal or ceramic. The rotational velocity (in rpm) for smaller power tools will also change as the diameter of the drill changes, for example a drill used for printed circuit boards could run as fast as 30,000 rpm and be 0.3 mm in diameter whereas a wood drill could be 65 mm in diameter and run at 600 rpm. Those skilled in the art can easily determine the required rotational velocity (rpm) optimum for various material tool combinations for smaller power tools. Though the percussion device (1) may be built into a smaller power tool it could also be provided as a separate attachment for a smaller power tool, for example driven by the chuck of an electric drill. Notwithstanding the above ranges it is expected that for drilling rig applications the percussive impulse frequency will be from 0.1 to 150 Hz, though some applications may fall in the range of 0.05 Hz to 500 Hz In a further variant there are two interlinked percussion impactors (25), one for starting a pile and the other for driving it to completion able to be separated so as to engage the one required. This could also be a single percussion impactor (25) with two separate drive transmitter pathways (26) and a method of varying how far the drive transmitters (21) extend from the drive wall (58). The drive transmitters (21) engaging with the desired drive transmitter pathway (26) depending on the extension.

The force unit (22) for any of the variants can be any known device that allows the storage of energy as it is compressed, and the release of this energy as it is allowed to decompress. For example compression springs with constant or variable rates, a plurality of compression springs of constant or variable rate, gas springs of variable or constant rate, solid elastomeric springs (for example those described in U.S.20130069292) sometimes called elastomer springs, magnetic springs (for example those described in U.S. Pat. No. 3,467,973) or a combination of one or more of these.

For certain applications the force unit (22) may be a space that allows the percussion impactor (25) to rise upwards against gravity, the percussion impactor (25) simply falling under gravity to generate the percussive impulse.

Though not shown in all variants, for clarity, the isolation buffer (90) and optional supplementary isolation buffer (91) can be present in any variant. The isolation buffer (90) and optional supplementary isolation buffer (91) can be as described earlier or have a construction similar to that described for the force unit (22).

The isolation buffer (90) and optional supplementary isolation buffer (91) may act to seal the gap between the outer casing (2) and the isolator (38) or there may be additional sealing rings of known type present.

Where the term drive unit (5,120) is used it is intended to cover any drive device used to rotationally drive a drill string, drill or drill bit, for example a hydraulic or electric motor, a diesel engine, a hydraulic motor with gearbox, an electric motor plus gearbox, etc.

The number of drive transmitters (21) present can be any number from 1 upwards, the specific variants are likely to have 2 to 6, but for correct operation it is believed that the number should not exceed the number of wavelengths present in the drive transmitter pathway (26).

Figure 26:
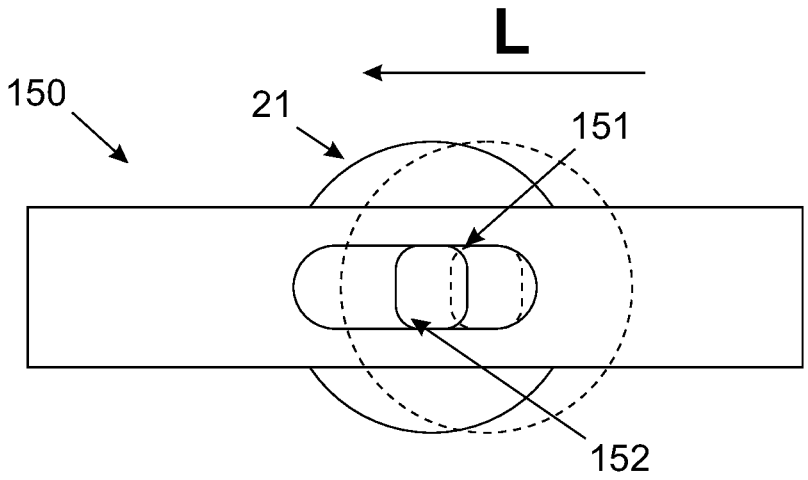
FIG. 26 is a side view of a sigma device.

With the loads applied to the or each drive transmitter (21) and drive transmitter pathway (26) a mechanism that reduces the load on, and/or contact force between, these components may be necessary to increase their lifespan, and/or increase the efficiency of the percussion device (1) (see any of FIGS.s 3, 11 to 14, or 21 to 25). One way of reducing this load is to allow each drive transmitter (21) to move forward once it clears the apex of a tooth section (81). Referring to FIG. 26 one mechanism that will allow this is shown, this mechanism, a sigma device (150), is an annular cylindrical ring with a pin slot (151) for each transmitter pin (152). Depending on which version of the percussion device (1) is used this annular ring is attached to the outer casing (2) or the percussion impactor (25) and each pin slot is a circumferentially aligned obround slot extending into or through said sigma device (150). A drive transmitter (21) is attached to a transmitter pin (152) and each transmitter pin (152) lies within a complementary pin slot (151). Each transmitter pin (152) can slide (or otherwise move lengthwise) along the pin slot (151) if the load applied does not prevent this from happening. In operation, with the input side rotating (see FIG. 3 for example) in the direction of arrow L, and the or each drive transmitter (21) in contact with the lift section (96), but not passing over the apex of the relevant tooth section (81), the transmitter pin (152) is in the load position. In this load position each transmitter pin (152) is held in contact with a sigma load end (153), the transmitter pin (152)/drive transmitter (21) is shown in dashed lines in this load position. If a drive transmitter (21) passes over the apex of the relevant tooth section (81) then the load keeping the connected transmitter pin (152) drops off and it can move along the length of the pin slot (151) reducing the contact load between the drive transmitter (21) and the drive transmitter pathway (26). Please note that the transmitter pin (152) can have any suitable cross section, and in some configurations it may be circular and act as an axle for the associated drive transmitter (21).

The sigma device (150) is optional and though in optimum configurations it is likely to be present the form of the sigma device (150) can vary.

Figure 27:
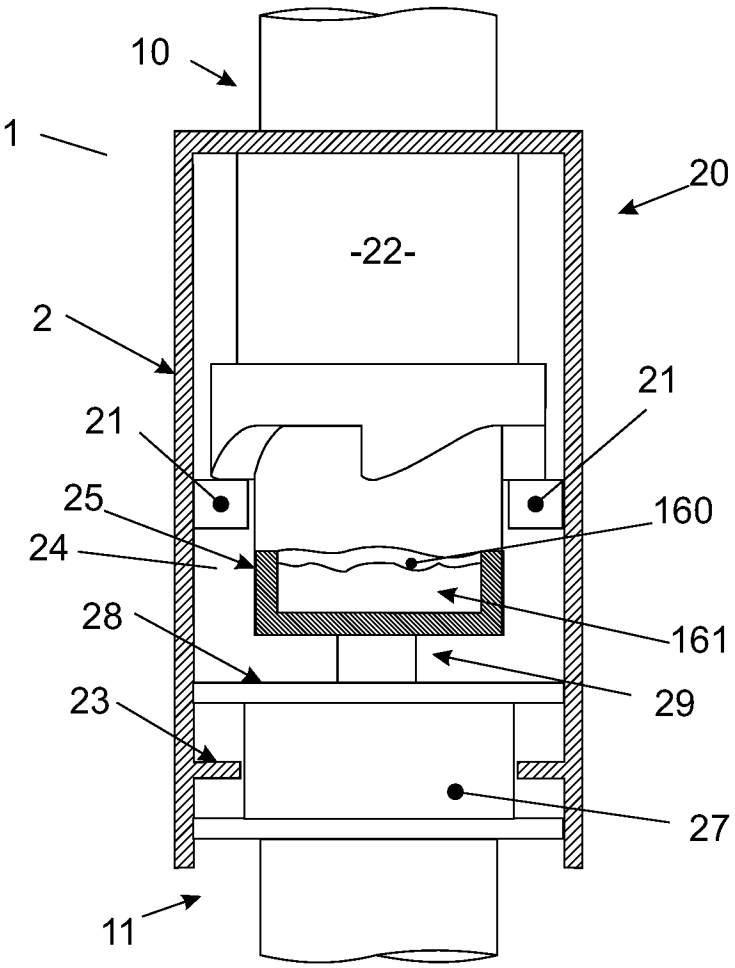
FIG. 27 is a cross sectional view of a variant with a force unit which is not a spring, and an optional fluid reservoir containing a reservoir liquid, with the outer casing cut along the line A-A and viewed in the direction of arrows A-A, of the percussion device.

For clarity FIG. 27 shows a cross sectional view of one variant of the percussion device (1) which includes a force unit (22) that optionally does not include a spring. This variant is shown with the optional internal fluid reservoir (160) which contains a reservoir liquid (161). The reservoir liquid (161) may fill the fluid reservoir (160) but it may not be so as to impart certain dynamic characteristics to the percussion impactor (25).

Figure 28:
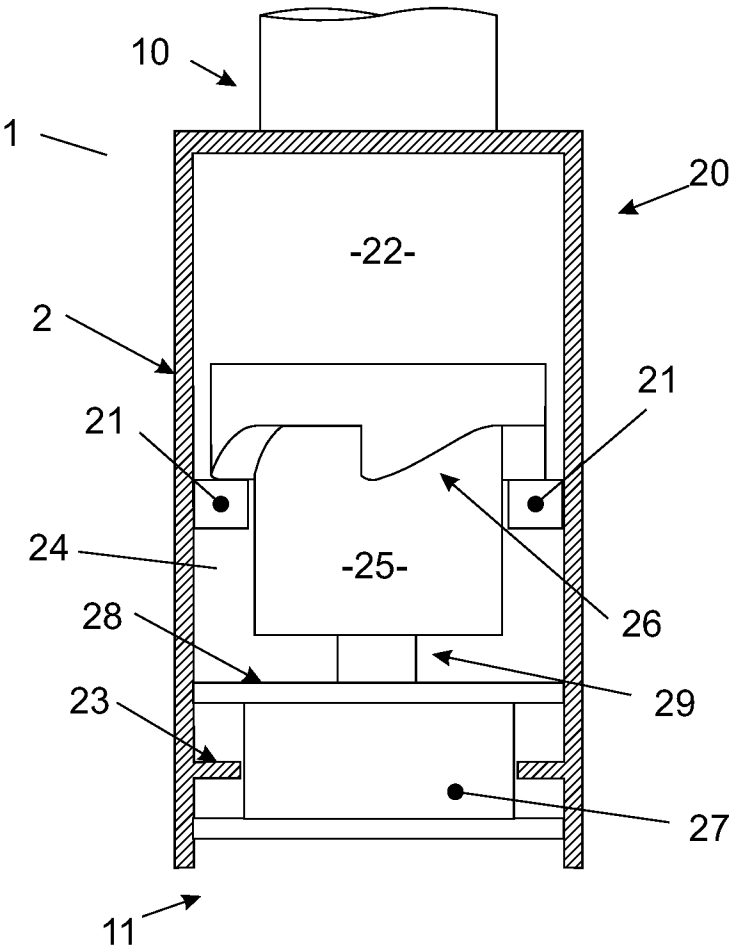
FIG. 28 is a cross sectional view of a variant with a force unit which is not a spring, with the outer casing cut along the line A-A and viewed in the direction of arrows A-A, of the percussion device.

Referring to FIG. 28 one variant of a percussion device (1) is shown, in this variant the force unit (22) is in fact simply a void, the percussive force being generated by the percussion assembly (24) simply falling under the influence of gravity.

Figure 29:
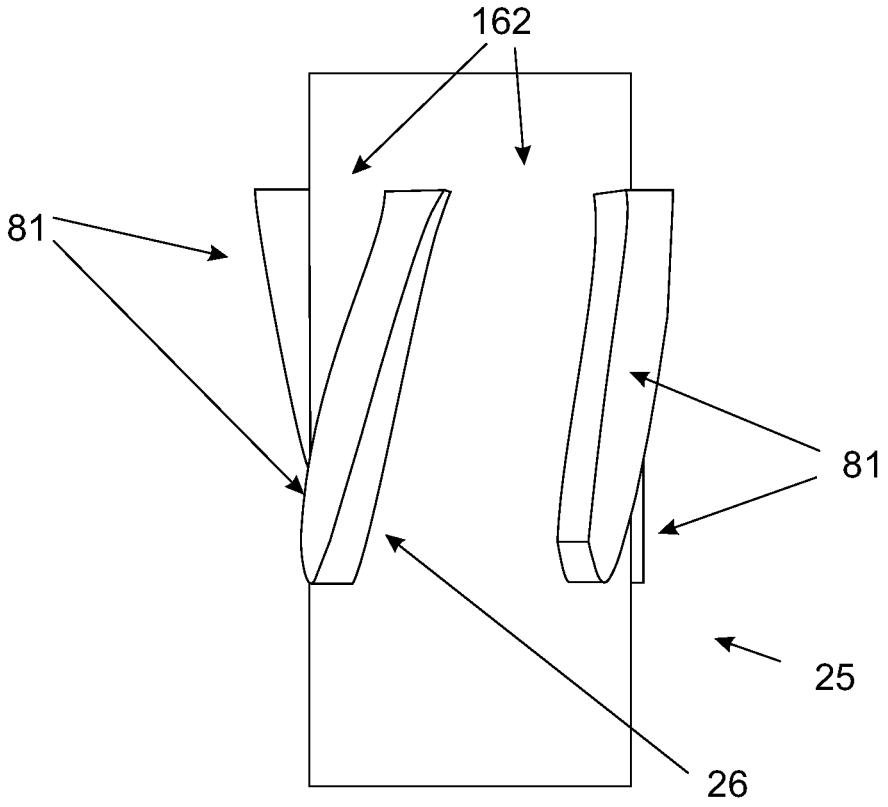

It should be noted that although the drive transmitter pathway (26) is shown as a continuous pathway, it may in fact be implemented as a series of disconnected teeth as the drive transmitters (21) are not intended to contact the base section (80) immediately downstream of the lift section (96). If a drive transmitter (21) impacts the base section (80) downstream of the lift section, as/before the percussive impulse is generated, it will likely reduce the percussive impulse generated as the percussion impactor (25) hits the percussion anvil (28), in addition the drive transmitters (21) may be damaged by the impact. This variant, implemented on a percussion impactor (25), is shown in FIG. 29 where the percussion impactor (25) consists of a plurality of spaced apart tooth sections (81), with the drive transmitter pathway (26) being the combination of the tooth sections (81) and the spaces (162).between. A similar variant (not shown) with the drive transmitter pathway (26) located on the drive wall (58) can also be implemented.

As can be seen various components from different variants and/or embodiments can be combined without departing from the inventive concept to achieve different operational parameters. For example the spacing between the tooth sections, the number of tooth sections, the length of the lead section, whether the drive transmitters are attached to the percussion impactor or the casing, the number of drive transmitters, whether the drive transmitter pathway is a series of spaced apart tooth sections or a continuous path, the form of the force unit, the form of the drive transmitters, the presence of a sigma device, or any similar components can be combined without deviating from the inventive concept.

KEY

1. Percussion Device;
2. Outer casing (of percussion device);
3. Rig;
5. Main drive unit;
6. Standard drills;
7. Concentric drill;
8. Pile driver;
9. Drill string prior to input side;
10. Input side;
11. Output side;
20. Input assembly;
21. Drive transmitters (rollers or other interior features of the outer casing or impactor),
22. Force unit (part of percussion unit that applies force to percussion impactor);
23. alpha section (section of outer casing that acts cooperatively with the isolation section to isolate the input and output sides);
24. Percussion assembly;
25. Percussion impactor (part of percussion assembly that acts as a hammer);
26. Drive transmitter pathway (guide path for drive transmitters;
27. Output assembly (part of percussion device located on output side);
28. Percussion anvil;
29. Impactor shaft (elongate member that slidingly engages with the impactor);
30. First section (of impactor); 30*a* First Section side wall;
31. Impact end (of impactor);
32. Pathway section (of impactor or outer casing); 32*a* Second Section side wall;
33. Force input end (FI end of impactor);
34. IS (Impactor Shaft) tunnel;
36. Isolation section (isolates interior of percussion device from outside);
37. Isolation support;
38. Isolator;
39. Isolation disc;
40. Output shaft;
50. Body portion (of outer casing);
51. Base portion (of outer casing);
54. Input face (of outer casing base portion);
55. Force face (of outer casing face that engages force unit);
56. Primary end (casing end of force unit);
57. Open casing end (opposite open terminal end of the outer casing);
58. drive wall (inner face of outer casing);
59. exposed casing wall;
60. primary end (of force unit);
61. secondary end (of force unit);
70. transmitter surface (surface of drive transmitter that contacts the drive transmitter pathway);
75. pathway waveform;
80. base section (of pathway waveform (75));
81. tooth section (of pathway waveform (75));
83. scalloped out section;
90. isolation buffer;
91. supplementary isolation buffer;
95. lead section (of tooth section);
96. lift section;
100. Sliding joint;
101. Primary shaft;
102. Secondary shaft;
104. Primary reduced section;
105. Primary expanded end;
106. Primary terminal end;
107. Primary shaft hole;
108. Primary shaft hole;
109. Tau terminal end;
110. Tau aperture;
115. Locking device;
116. Pile;
117. Ground;
120. Percussion drive unit;
121. Drill;
125. Shaft terminal end;
126. Mast;
130. Fluid conduit;
131. Swivel;
132. Drill bit;
133. Drill string;
134. Impactor pathway;
135. output pathway;
136. bit sliding joint;
140. inner drill string;
141. casing;
150. Sigma device;
151. Pin Slot;
152. Drive Pin;
153. Sigma load end.
160. fluid reservoir;
161. reservoir liquid;
162. spaces (between separate tooth sections;
TL=Tooth Length

The invention claimed is:

1. A percussion device that includes:
an input side;
an output side;
at least one drive transmitter;
a drive transmitter pathway;
a percussion impactor; and
a percussion anvil;

where:
the drive transmitter pathway is a circumferential pathway around a longitudinal axis of the percussion device;
the drive transmitter pathway includes at least one tooth section including a lift section and a lead section;
the at least one tooth section is essentially one wavelength of a sawtooth wave;
the lift section is inclined away from a base of the drive transmitter pathway;
the lead section is a section of the at least one tooth section which abruptly returns to the base of the drive transmitter pathway;

the percussion anvil is attached to, or forms part of, the output side;

the output side includes an impactor shaft which is an elongate member extending above the percussion anvil;

the impactor shaft is aligned with the longitudinal axis of the percussion device;

the percussion impactor includes an impactor shaft tunnel which is a void longitudinally aligned with the longitudinal axis of the percussion device;

the impactor shaft is a longitudinal sliding fit within the impactor shaft tunnel;

the impactor shaft and the impactor shaft tunnel have complementary cross sections configured to minimise any differential rotational motion between the percussion impactor and the impactor shaft when the output side is free to rotate;

the percussion impactor includes an impact end and a force input end which are longitudinally opposite terminal ends of the percussion impactor;

the impact end faces the percussion anvil; and neither the impact end or the percussion anvil are coterminous with either the drive transmitter pathway or the at least one drive transmitter;

such that:

when in use, and the output side is free to rotate, the at least one drive transmitter and the drive transmitter pathway are configured to act co-operatively to transfer the rotational motion of the input side to the output side; and when in use and limited or no rotation of the output side is possible, the at least one drive transmitter and the drive transmitter pathway are configured to act co-operatively to increase, maintain or decrease the distance between the percussion impactor and the percussion anvil, without affecting the rotation of the input side;

wherein the at least one drive transmitter and the drive transmitter pathway are configured to act co-operatively to accept rotational motion from the input side and, in combination with the percussion impactor, transmit a percussive and/or rotational motion to the output side.

2. The percussion device as claimed in claim 1, wherein the cross section of the impactor shaft and the impactor shaft tunnel are selected from the following list, rectangular, square, irregular polygon, regular polygon star shaped, cross shaped, oval, elliptical, lobed, any of the previously mentioned shapes with rounded corners (if present) and obround.

3. The percussion device as claimed in claim 1, wherein the impactor shaft is longitudinally twisted.

4. The percussion device as claimed in claim 3, wherein the twist is between $1/20^{th}$ and ¾of a turn.

5. The percussion device as claimed in claim 3, wherein the at least one tooth section comprises a plurality of a plurality of tooth sections, which in combination with spaces between said tooth sections form a continuous circumferential pathway.

6. The percussion device as claimed in claim 1, wherein the drive transmitter pathway is a continuous circumferential pathway.

7. The percussion device as claimed in claim 1, wherein the at least one tooth section comprises a plurality of spaced tooth sections, which in combination with spaces between said tooth sections form a continuous circumferential pathway.

8. The percussion device as claimed in claim 1, wherein the input side includes a casing which at least partially surrounds the percussion impactor and percussion anvil.

9. The percussion device as claimed in claim 8, wherein the casing includes a force face, where said force face is an inner face of the casing that faces the force input end of the percussion impactor.

10. The percussion device as claimed in claim 9, wherein a force unit lies between the force face and the force input end, such that the force unit stores energy as it is compressed.

11. The percussion device as claimed in claim 10, wherein the force unit is one or more devices independently selected from the following list a constant or variable rate compression spring, a constant or variable rate solid elastomeric spring, a constant or variable rate magnetic spring and a gas spring.

12. The percussion device as claimed in claim 10, wherein the impactor shaft is longitudinally twisted.

13. The percussion device as claimed in claim 8, wherein the drive transmitter pathway forms part of, or is attached to, the percussion impactor and the at least one drive transmitter is attached to a drive wall, where the drive wall is an inner wall of the casing.

14. The percussion device as claimed in claim 8, wherein the at least one drive transmitter forms part of the percussion impactor and the drive transmitter pathway is attached to, or formed as part of, a drive wall, where the drive wall is an inward facing wall of the casing.

15. The percussion device as claimed in claim 1, wherein the at least one drive transmitter is a roller or a follower configured to slide or roll along at least part of the length of the drive transmitter pathway.

16. The percussion device as claimed in claim 1, wherein the lift section includes a scalloped indent.

17. The percussion device as claimed in claim 1, wherein the output side can be rotationally locked.

18. The percussion device as claimed in claim 17, wherein when the output side is rotationally locked the percussion device imparts essentially percussive force to the output side.

19. The percussion device as claimed in claim 1, wherein the output side is attached to a drill string including a drill bit, or a drill bit.

20. The percussion device as claimed in claim 1, wherein the at least one tooth section is followed by a base section.

21. The percussion device as claimed in claim 20, wherein the input side includes a casing which at least partially surrounds the percussion impactor and percussion anvil and wherein the base section is a space or a portion of the drive transmitter pathway that is either:

i. essentially a constant distance from the impact end, when the at least one tooth section is attached to the percussion impactor; or ii. essentially a constant distance from an end of the casing, when the at least one tooth section is attached to said casing.

22. The percussion device as claimed in claim 20, wherein the base section is a space or void.

23. The percussion device as claimed in claim 20, wherein the base section, measured circumferentially, has a length of between 0.5 and 4 times the length of the at least one tooth section, measured circumferentially.

* * * * *